US009320930B2

(12) United States Patent
Abels et al.

(10) Patent No.: US 9,320,930 B2
(45) Date of Patent: Apr. 26, 2016

(54) CONCEALED SPRINKLER

(75) Inventors: Bernhard Abels, Warwick, RI (US); Manuel R. Silva, Jr., Cranston, RI (US); Marcelo J. Chavez, Providence, RI (US)

(73) Assignee: Tyco Fire Products LP, Lansdale, PA (US)

( * ) Notice: Subject to any disclaimer, the term of this patent is extended or adjusted under 35 U.S.C. 154(b) by 987 days.

(21) Appl. No.: 13/376,058

(22) PCT Filed: Jun. 7, 2010

(86) PCT No.: PCT/US2010/037636

§ 371 (c)(1), (2), (4) Date: Jul. 3, 2012

(87) PCT Pub. No.: WO2010/141948

PCT Pub. Date: Dec. 9, 2010

(65) Prior Publication Data

US 2012/0267125 A1 Oct. 25, 2012

Related U.S. Application Data

(60) Provisional application No. 61/184,741, filed on Jun. 5, 2009.

(51) Int. Cl.
*A62C 37/08* (2006.01)

(52) U.S. Cl.
CPC ..... *A62C 37/08* (2013.01)

(58) Field of Classification Search
CPC ..... A62C 37/08; A62C 37/11; A62C 37/12
USPC ..... 169/37, 38, 39, 19, 41, 42; 239/505, 239/507
See application file for complete search history.

(56) References Cited

U.S. PATENT DOCUMENTS 6,152,236 A * 11/2000 Retzloff et al. ..... 169/57
7,353,882 B2 * 4/2008 Pahila ..... 169/37

FOREIGN PATENT DOCUMENTS

WO WO 2006/133057 A2 12/2006
WO WO 2008/067421 A2 6/2008

OTHER PUBLICATIONS

International Searching Authority, Written Opinion issued in International Application No. PCT/US2010/037636, Sep. 6, 2010, 5 pages.
International Searching Authority, International Search Report issued in International Application No. PCT/US2010/037636, Sep. 6, 2010, 4 pages.

* cited by examiner

*Primary Examiner* — Arthur O Hall
*Assistant Examiner* — Viet Le
(74) *Attorney, Agent, or Firm* — Perkins Coie LLP

(57) ABSTRACT

A concealed-type sprinkler that includes a body having a proximal portion defining an opening and a distal portion defining an outlet. The body defines an internal passageway having an inlet and an outlet spaced apart along a longitudinal axis. The distal portion preferably includes an annular wall having an outer surface and an inner surface to further define a chamber distal of the outlet to house an internal component of the sprinkler. A cover plate assembly substantially conceals the chamber and includes a thermally responsive surface in communication with the chamber to actuate the sprinkler. The preferred sprinkler preferably includes a spacing member disposed between the annular wall and the cover plate assembly to define at least one aperture for communication between the chamber and the environment external to the sprinkler. An escutcheon is preferably disposed about the annular wall.

37 Claims, 19 Drawing Sheets

CONCEALED SPRINKLER

PRIORITY DATA & INCORPORATION BY REFERENCE

This application is a 35 U.S.C. §371 application of International Application No. PCT/US2010/037636, filed Jun. 7, 2010, which claims the benefit of priority to U.S. Provisional Patent Application Nos. 61/184,741, filed Jun. 5, 2009, each of which is incorporated by reference in its entirety.

TECHNICAL FIELD

The present invention relates generally to fire protection devices and more specifically to concealed fire protection sprinklers used preferably, for example, in concrete ceiling and/or other residential installations.

BACKGROUND ART

Concealed-type fire protection sprinklers, which discharge a fire fighting fluid such as a water, gas or other chemical agent, can be designed to protect a variety of occupancies, both commercial and residential. Generally, the concealed nature of these sprinklers obscures the internal components of the sprinkler from view for at least aesthetic reasons depending upon the given installation. In addition or in the alternative, the concealing structure of the concealed-type sprinkler can protect the internal components from either tampering or accidental impact. Regardless of the purpose of the concealing structure of the sprinkler, it is critical that the concealing structure not interfere with the thermal responsiveness or operation of the sprinkler. This is particularly true in which the concealed-type sprinkler must satisfy a response time requirement or standard in order to be listed under any one of the applicable installation/sprinkler standards for a particular occupancy such as, for example, protection of a residential occupancy.

DISCLOSURE OF INVENTION

The present invention is directed to a concealed-type sprinkler that includes a concealing structure that does not interfere with the thermal and operational components of the sprinkler. More preferably, the concealing structure facilitates the thermal responsiveness of the sprinkler. In addition, the preferred concealed-type sprinkler provides for a compact assembly which enhances the ability of the sprinkler to provide an aesthetically pleasing installed appearance.

One preferred embodiment of the sprinkler includes a body having a proximal portion defining an opening and a distal portion defining an outlet. The body defines an internal passageway having an inlet and an outlet spaced apart along a longitudinal axis. The distal portion preferably includes an annular wall having an outer surface and an inner surface to further define a chamber distal of the outlet to house an internal component of the sprinkler. A cover plate assembly preferably substantially conceals the chamber. The cover plate assembly further preferably has a thermally responsive surface exposed to the chamber to actuate the sprinkler. The preferred sprinkler preferably includes a spacing member disposed between and preferably engaged with the annular wall and the cover plate assembly. The spacing member preferably provides means for defining at least one aperture which provides communication between the chamber and the environment external to the chamber or sprinkler, such that the surface of the cover plate that is exposed to the chamber is also exposed to the external environment. In another preferred embodiment of the sprinkler, an escutcheon is disposed about the annular wall. The escutcheon includes a proximal end face and a distal end face. The escutcheon further preferably tapers in the proximal to distal direction toward the axis such that the distal end face of the escutcheon is located proximally of the spacing member.

The spacing member is preferably formed as a ring member. The preferred ring member includes an upper surface and a lower surface, the lower surface having a plurality of radially spaced apart posts which define the apertures and engage the cover plate assembly.

BRIEF DESCRIPTION OF DRAWINGS

The accompanying drawings, which are incorporated herein and constitute part of this specification, illustrate exemplary embodiments of the invention, and together, with the general description given above and the detailed description given below, serve to explain the features of the invention. It should be understood that the preferred embodiments are some examples of the invention as provided by the appended claims.

MODE(S) FOR CARRYING OUT THE INVENTION

Figure 1:
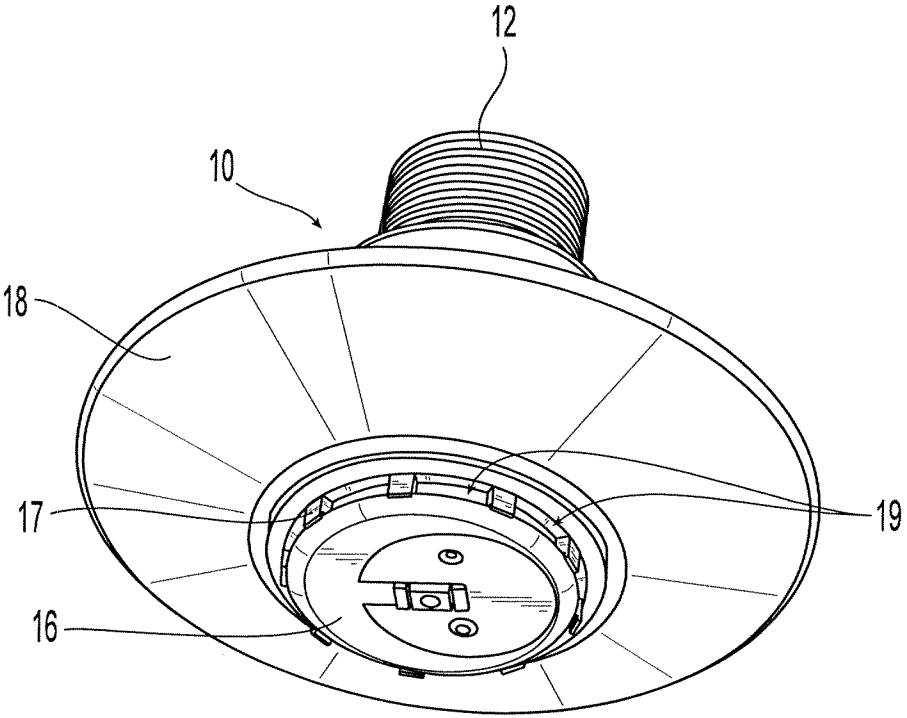
FIG. 1 is a first embodiment of a preferred concealed sprinkler assembly.
Figure 2:
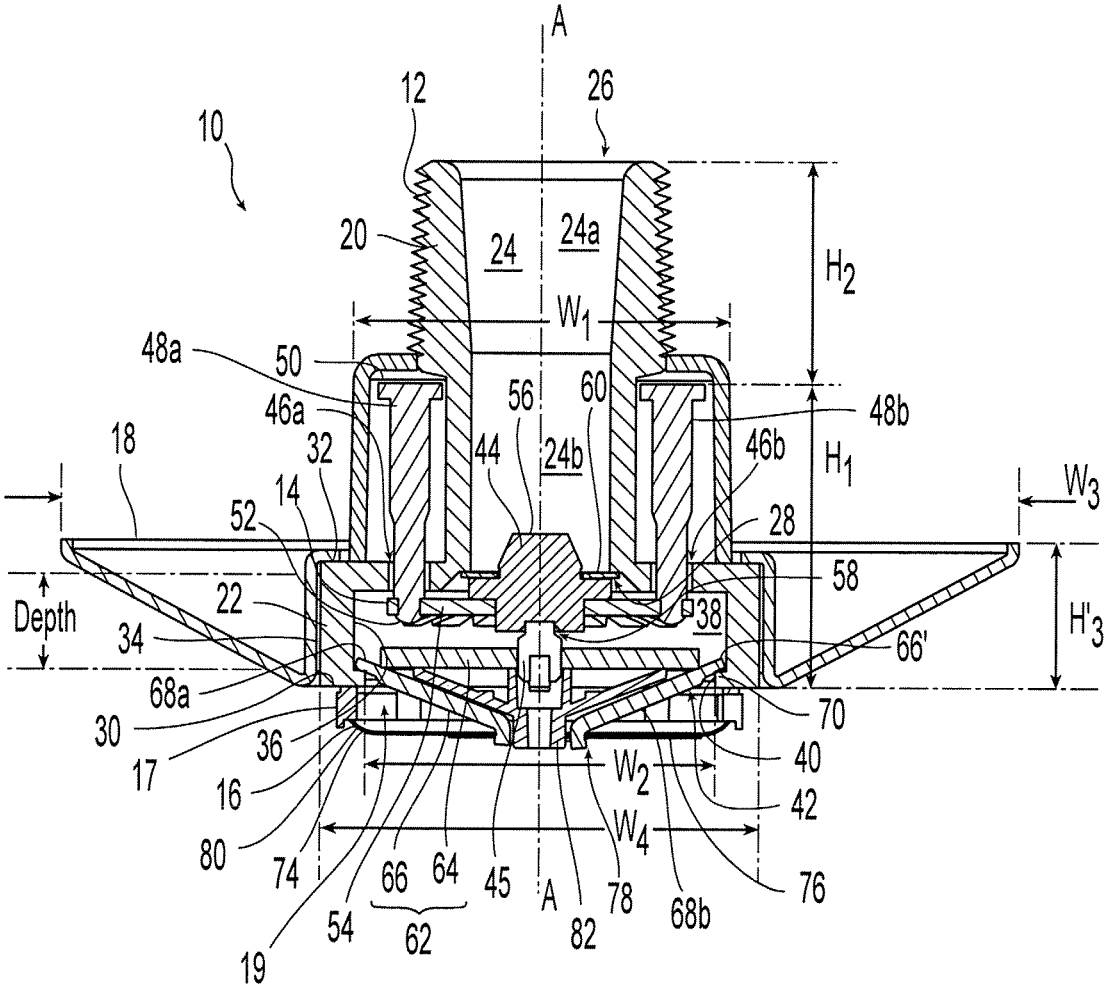
FIG. 2 is a cross-sectional view of the concealed sprinkler assembly of FIG. 1.

Shown in FIGS. 1 and 2 is an illustrative embodiment of a concealed-type sprinkler 10, which is preferably configured in accordance with either one of or both Underwriters Laboratories, Inc. ("UL") Standard 1626 (2004) or later versions, i.e., (2008), entitled "Residential Sprinklers for Fire Protection Service" and UL Standard 199 (2004) or later versions, i.e., (2008), entitled, "Automatic Sprinklers for Fire-Protection Service." The concealed-type sprinkler 10 is further preferably configured for use in a commercial, institutional, concrete and/or a residential applications as defined by applicable installation requirements of any one of National Fire Protection Association (NFPA) Standards: NFPA-13 (2007) or later versions, i.e., (2010) entitled, "Standards for the Installation of Sprinkler Systems"; NFPA-13D (2007) or later versions, i.e., (2010) entitled, "Standards for the Installation of Sprinkler Systems in One- and Two-Family Dwellings and Mobile Homes; and NFPA-13R (2007) or later versions, i.e., (2010) entitled, "Standards for the Installation of Sprinkler Systems In Residential Occupancies up to and Including Four Stories in Height." Each of the above-identified standards is incorporated by reference in its entirety. The sprinkler 10 can be configured for pendent style mounting with a pendent style deflector as shown, for example, in FIG. 1, or alternatively, the sprinkler 10 can be configured for sidewall or substantially horizontal mounting with a sidewall deflector as shown, for example, in FIGS. 7-10A.

Referring again to FIGS. 1 and 2, the preferred sprinkler 10 generally includes a sprinkler body 12 that defines an internal chamber for housing internal sprinkler components such as, for example, a deflector assembly and an internal trigger assembly. The sprinkler 10 further includes a cover plate assembly 16, which at least partially conceals the internal components of the sprinkler and preferably doubles as a thermally rated link device to define the thermal rating and sensitivity of the sprinkler.

To ensure the desired thermal responsiveness of the sprinkler, the sprinkler 10 preferably includes one or more spacing members 17 disposed between the sprinkler body 12 and the cover plate assembly 16 to define a plurality of openings 19 radially spaced about the internal chamber of the sprinkler 10 such that both the upper (proximal) and lower (distal) surfaces of the link device of the cover plate assembly 16 are exposed to the external environment. Heat from a fire can pass through the openings 19 to flow about the upper and lower surfaces of the link device of the cover plate assembly 16 so that the sprinkler 10 can respond in a desired manner. Accordingly, the preferred spacing member 17 provides a means for controlled heat transfer or flow between the external environment and the internally concealed surfaces of the trigger device of the cover plate assembly to ensure that the sprinkler is sufficiently thermally sensitive for the desired application.

Moreover, the spacing member 17 is preferably disposed between the sprinkler body 12 and the cover plate assembly 16 such that the sprinkler 10 has a compact assembly in which the apertures 19 present the discontinuity in the otherwise substantially continuous axial profile from the proximal end of the sprinkler body 12 to the distally located cover plate assembly 16. Accordingly, the preferred sprinkler 10 provides for a compact assembly that adequately conceals and protects the operative components of the sprinkler to present an aesthetically pleasing sprinkler installation, yet the compact concealed assembly does not hinder or interfere with the thermal responsiveness of the sprinkler. The sprinkler 10 preferably has a response time index (RTI) of about 50 $(m\text{-}s)^{1/2}$ and more preferably less than 50 $(m\text{-}s)^{1/2}$. A preferred embodiment of the sprinkler 10 has an RTI of about 30.5 $(m\text{-}s)^{1/2}$ as determined by a known RTI testing standard, such as for example, the European standard, VDS although the RTI can be determined by other known equivalent standards and techniques.

The sprinkler 10 is further preferably disposed within a mounting element 18 for mounting to a ceiling structure such as, for example, a concrete formed ceiling, ceiling tile, dry wall ceiling or other structure forming the mounting surface. The mounting element 18 is preferably an escutcheon 18 having a proximal end face for engaging the ceiling construct. The escutcheon 18 preferably tapers from the proximal end face to a distal end face which is preferably flush with a distal end of the body 12. The escutcheon 18 also preferably provides a deflecting or reflecting surface for air currents flowing about the sprinkler 10. More preferably, the tapered surface of the escutcheon 18 and the location of its distal end face redirect gas or air that has been heated by a fire through the openings 19 of the spacing member 17 and into the internal chamber of the sprinkler. The thermally sensitive surfaces of the thermal link device of the cover plate assembly 16 are thereby sufficiently exposed to the heat to facilitate the desired thermal actuation of the sprinkler.

Referring to the view of FIG. 2, the sprinkler 10 is shown in cross-section with the sprinkler body 12 disposed within the escutcheon 18. The body 12 preferably includes a proximal portion 20 and a distal portion 22. The distal portion 22 preferably includes an annular wall 30 having a proximal edge 32 contiguous and more preferably integral with the proximal portion 20. The annular wall 30 further includes a distal edge 40 defining a distal opening 42 preferably at the distal end of the body 12. The annular wall 30 has a preferred overall height from the proximal edge 32 to the distal edge 40 of about 0.4 inches. In the preferred assembly of the sprinkler 10, the distal edge 40 of the annular wall 30 engages the spacing member 17. In order to redirect a sufficient flow of heat into the openings 19 defined by the spacing member 17, the escutcheon 18 has a preferred overall height $H'_3$ to locate the spacing member 17 and cover plate assembly 16 in a region of sufficient air flow spaced from the ceiling surface. Preferably, the height $H'_3$ of the escutcheon 18 is about 0.4 inches. In one embodiment of the sprinkler assembly, the proximal end 20 of the sprinkler 12 is initially inserted into the escutcheon through the distal opening of the escutcheon 18. The escutcheon 18 preferably includes an internal backstop that engages the proximal edge 32 of the annular wall 30 to limit axial travel so as to locate the distal end face of the escutcheon 18 flush with the distal edge 40 of the body 12 proximal of the spacing member 17. Accordingly the sprinkler and escutcheon assembly are installed together and coupled to the fluid supply or branch line.

Figure 2A:
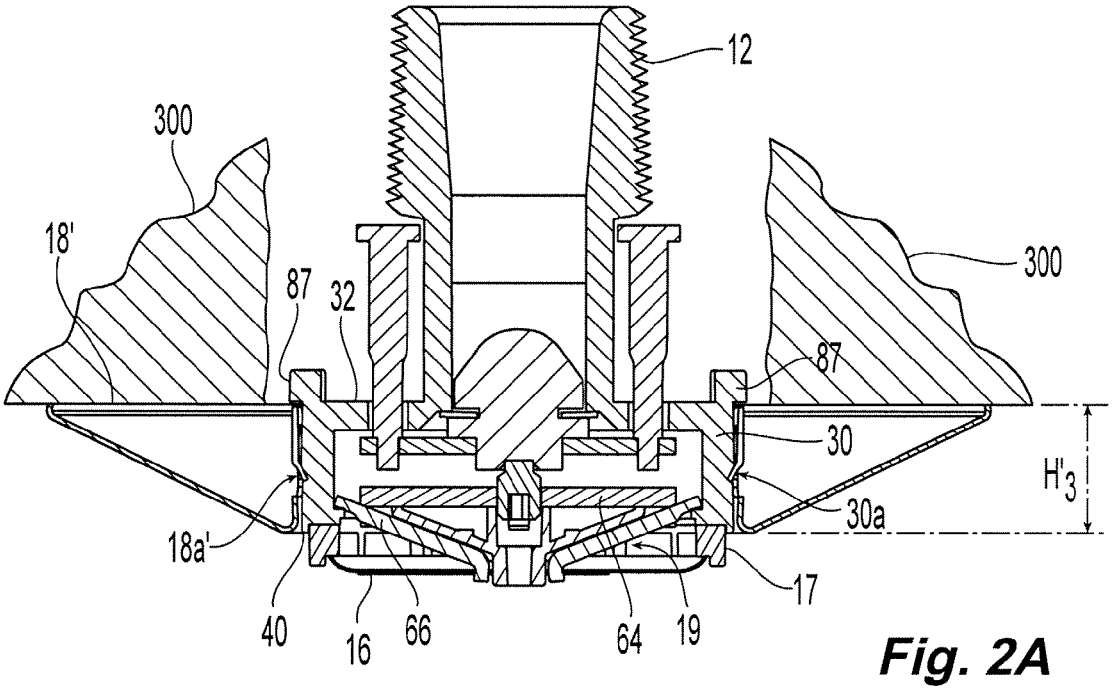
FIG. 2A is a cross-sectional view of another preferred concealed sprinkler.
Figure 3:
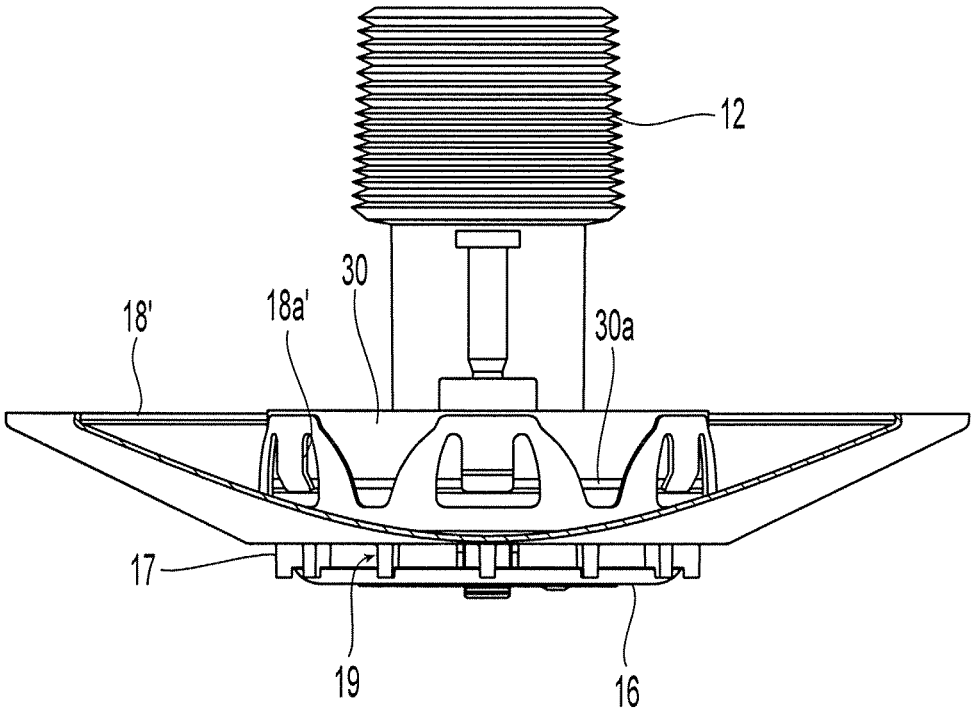
FIG. 3 is a detailed isometric view of a preferred sprinkler body and escutcheon assembly for use in the concealed sprinkler of FIG. 1.

An alternate sprinkler-escutcheon assembly is shown in FIGS. 2A and 3 with the assembly in a concrete installation 300. In the presence of a fire, the concrete ceiling 300 acts as heat sink and the velocity of the air flow at the ceiling surface is about zero. In order to redirect a sufficient flow of heat into the openings 19 defined by the spacing member 17, a preferred push-on escutcheon 18' has an overall height $H'_3$ to locate the spacing member 17 and cover plate assembly 16 in a region of sufficient air flow spaced from the ceiling surface. The escutcheon 18' is installed about the sprinkler annular wall 30 after the sprinkler 10 is installed and coupled to the fluid supply line. Referring specifically to FIG. 3, the push-on escutcheon 18' includes a central opening formed by a plurality of radially disposed tabs 18*a*' that engage the annular wall 30 of the sprinkler to locate the distal face of the escutcheon 18' proximally of the spacing member 17 so as to expose the apertures 19 to the environment. In one embodiment, the tabs 18*a*' are resilient with a central portion that is biased inward to engage a groove 30*a* circumferentially formed about the annular wall 30 to properly and securely locate the escutcheon about the sprinkler. Alternatively, resilient tabs 18*a*' can present a convex profile such that collectively, the tabs 18*a*' define an internal circumference that forms an interference fit about the annular wall 30 of the sprinkler in the absence of an outer groove to hold the escutcheon 18' securely about the sprinkler 10.

Figure 3A:
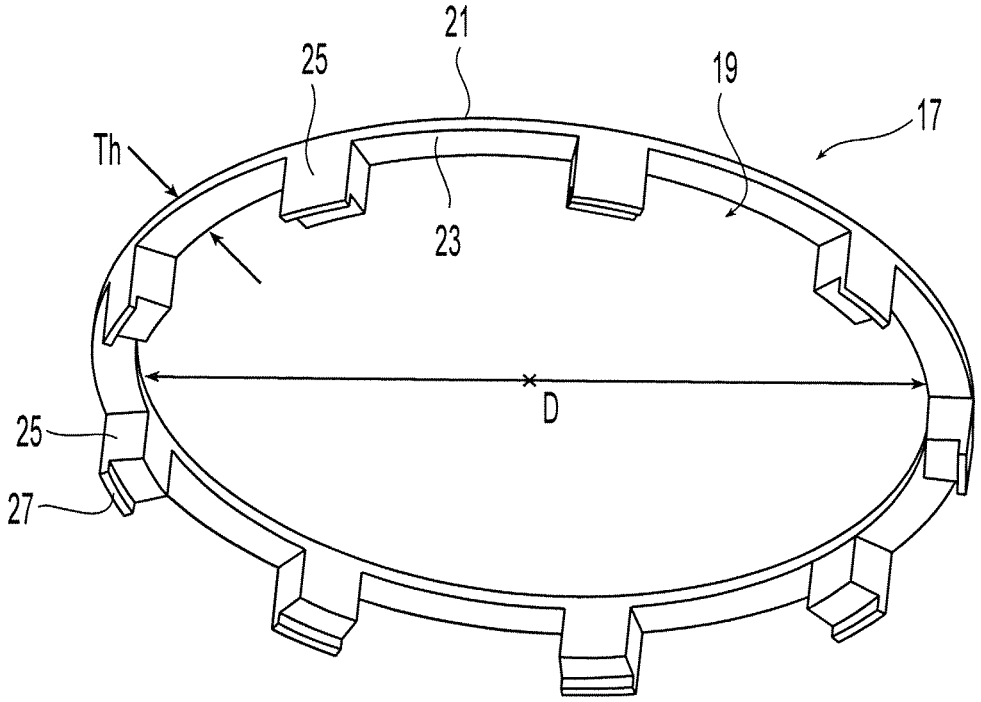
FIG. 3A is a preferred embodiment of a spacing member as used in the sprinkler of FIGS. 2 & 2A.

Shown in FIG. 3*a* is a preferred embodiment of the spacing member 17 configured as an annular ring 17 defining an internal diameter D and radial annular thickness Th to circumscribe the distal opening 42 of the sprinkler body 12. The internal diameter preferably ranges from about 1.0 inches to about 1.15 inches, and the radial thickness Th of the annular ring 17 preferably ranges from about 0.05 inches to about 0.15 inches. The annular ring 17 includes an upper surface 21 for engaging the distal edge 40 of the body 12 and a lower surface 23 for facing the cover plate assembly 16. The ring 17 may be alternatively configured to clip on to a portion of the body 12 so that upon sprinkler operation the ring 17 remains attached to the body 12. In one preferred embodiment, shown for example, in FIG. 2A, the ring 17 forms a close fit with a distal surface 40 of the body 12 formed to surround at least a circumferential portion of the ring 17.

Referring again to FIG. 3A, the lower surface 23 of the ring 17 preferably includes a plurality of radially spaced posts 25 for engaging and axially spacing the cover plate assembly 16 from the lower surface 23 of the annular ring 17. The radial spacing between the posts 25 and the axial spacing between the ring 17 and the cover plate assembly 16 define the openings 19 through which heat may travel into the interior chamber of the sprinkler 10. Accordingly, the number and size of the posts 25 can be configured to control the flow rate of heat into the internal chamber of the sprinkler to suit a particular application. Moreover, the number and size of the posts 25 can be configured to define the compactness of the sprinkler assembly. The posts 25 further preferably include peripheral tabs 27 to circumscribe and center the cover plate assembly 16.

The ring 17 is preferably made of a polymer material such as, for example, Teflon, polyethylene, polypropylene or more preferably nylon. Alternatively, the ring can be made of fiberglass or other material of suitable strength. The polymer preferably provides the ring 21 with insulation properties such that the ring 21 can behave as an insulator between the cover plate assembly 16 and the remainder of the sprinkler 10. By substantially insulating the cover plate assembly 16, heat from a fire event can impact the cover plate assembly 16 without significant heat transfer to other portions of the sprinkler 10 thereby facilitating appropriate thermal response by the cover plate assembly 16 in the presence of a heat or fire event.

The spacing member 17 is shown as a preferably unitary element. Alternatively, the member 17 can be defined by two or more elements to define the spacer or the preferred ring 17. Although the ring 17 preferably engages the distal surface 40 of the sprinkler 10, one or more spacing elements may be disposed between the sprinkler body 10 and the ring spacing member 17.

In alternate embodiments, other means may employed to provide the apertures 19 for communication between the internal chamber of the sprinkler body and the external environment. For example, the spacing member 17 may be an annular extension formed integrally with the sprinkler body and in contact with the cover plate assembly 16. Further in the alternative, the spacing member 17 may be an annular extension formed integrally with the cover plate assembly 16 in contact with the sprinkler body 12. In either of the alternate embodiments, the formed annular extension 17 should be provided with sufficient apertures 19 to ensure the proper thermal responsiveness of the sprinkler.

Referring again to FIGS. 1, 2 and 2A, the sprinkler body 12 generally defines a substantially circular cross-sections in a plane perpendicular to the longitudinal axis A-A; however, it should be understood that the body 12 can define other geometrical cross-sections such as, for example, oval or rectangular provided the body 12 can deliver the desired flow and pressure of fluid. The outer surface of the proximal portion 20 preferably includes a threaded end fitting for coupling the sprinkler 10 to a branch or fluid supply line of a sprinkler system containing a fire fighting fluid. An inner surface portion of the body 12 further defines an internal passageway 24 extending between an inlet 26 and an outlet 28 along a longitudinal axis A-A. The inlet 26 is preferably in communication with a tapering portion 24*a* of the passageway 24. The tapering passageway 24*a* is further preferably in communication with a distal portion 24*b* of the passageway having a constant diameter and terminating at the outlet 228. The passageway 24, inlet 26 and outlet 28 further preferably define a sprinkler constant or K-factor ranging from about 3 gallons per minute per pounds per square inch raised to the one-half power $(gpm/(psi))^{1/2}$ to about 5.8 $(gpm/(psi))^{1/2}$ and preferably ranges from about 4.9 to about 5.6 $(gpm/(psi))^{1/2}$ and is more preferably respectively either one of 4.9 $(gpm/(psi))^{1/2}$ or 5.6 $(gpm/(psi))^{1/2}$ depending upon the installation application as either a residential or a concrete sprinkler. The annular wall 30 includes an outer surface 34 and an inner surface 36 to further define the internal chamber 38 distal of the outlet 28 and in communication with the passageway 24. The outer surface 34 preferably defines a maximum diameter of about $W_4$ of about 1.4 inches to provide a close fit within the escutcheon 18.

The chamber 38 is preferably configured for housing internal components of the sprinkler 10, including a deflector assembly, a closure element and trigger assembly. The preferred deflector assembly 14 is coupled to the body 12 and is more preferably suspended in a telescoping manner from the proximal edge 32. More specifically, the proximal edge 32 preferably includes a pair of through holes 46*a*, 46*b* in communication with the chamber 38. The deflector assembly 14 preferably includes a pair of arms 48*a*, 48*b* engaged in the through holes 46*a*, 46*b*. The arms 48*a*, 48*b* each preferably include an enlarged proximal end 50 for engaging the proximal edge 32 of the annular wall 30 so as to limit the distal and axial travel of the arms 48*a*, 48*b* in the through holes 46*a*, 46*b*. The proximal edge 32 can include additional openings to provide space for housing additional components within the chamber 38, for example, the proximal edge 32 can include two substantially semi-circular openings disposed about the proximal portion 20 of the body 12. The additional openings can further provide a sprinkler assembler/installer with access to view the chamber 38.

Coupled to the distal end 52 of each arm 48*a*, 48*b* of the deflector assembly 14 is a deflector plate 54. The arms 48*a*, 48*b* preferably locate the deflector plate 54 at a first position within the chamber 38 distally adjacent the outlet 28. The deflector plate 54 further preferably includes a central hole with a closure element or assembly 44 engaged therein. With the deflector plate 54 located at its first position, the closure element 44 is preferably located in the outlet of the passageway 28 to prevent the flow of a fluid (liquid or gas) from the outlet of the passageway 24*b*. The closure element 44 preferably includes a closure button 56 having a preferably frustroconical tip. Preferably disposed about the closure button 56 is a biasing element 60 to bias the closure assembly 44 in the direction of the distal opening 42. Preferably, the biasing element 60 includes a Belleville spring disc having a spring force ranging from about 50 lbs. (222 Newtons) to about 120 lbs. (534 Newtons). With the closure element 44 in its sealing position, the frustroconical tip is preferably disposed within the passageway 24 and the biasing element 60 engages a preferably counter sunk surface forming the outlet 28 of the passageway 24.

Figure 2B:
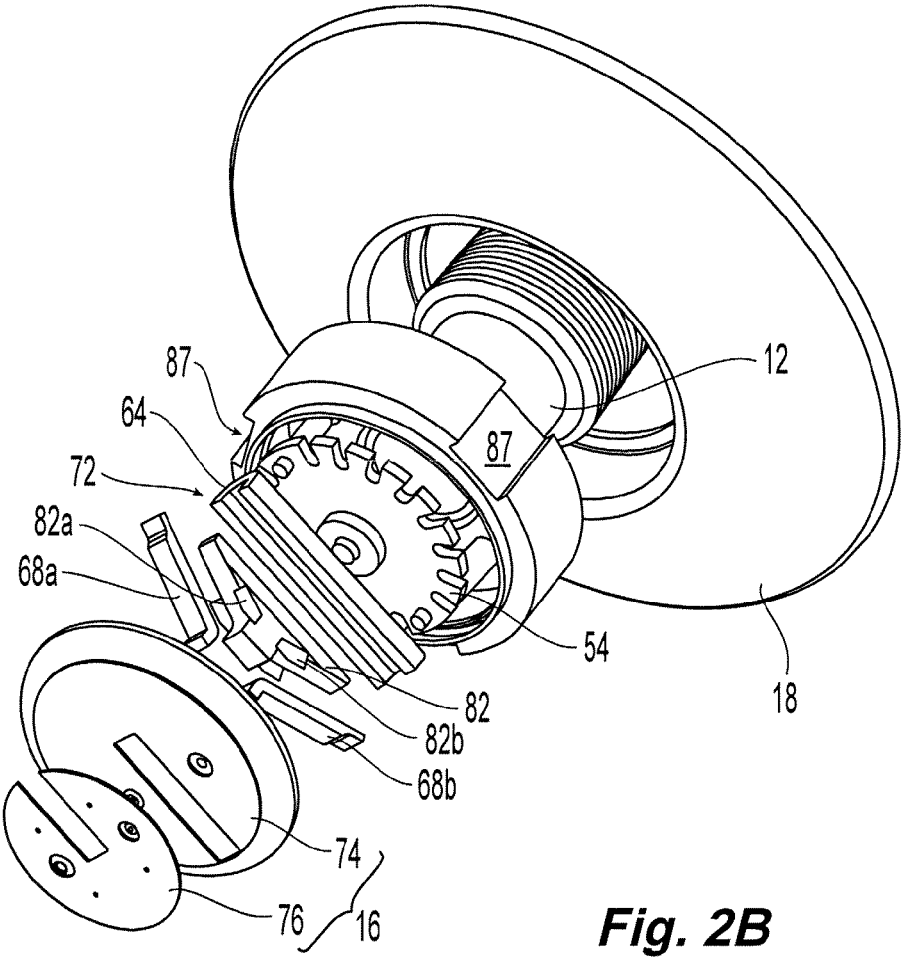
FIG. 2B is a partial exploded view of the sprinkler of FIG. 1.
Figure 2C:
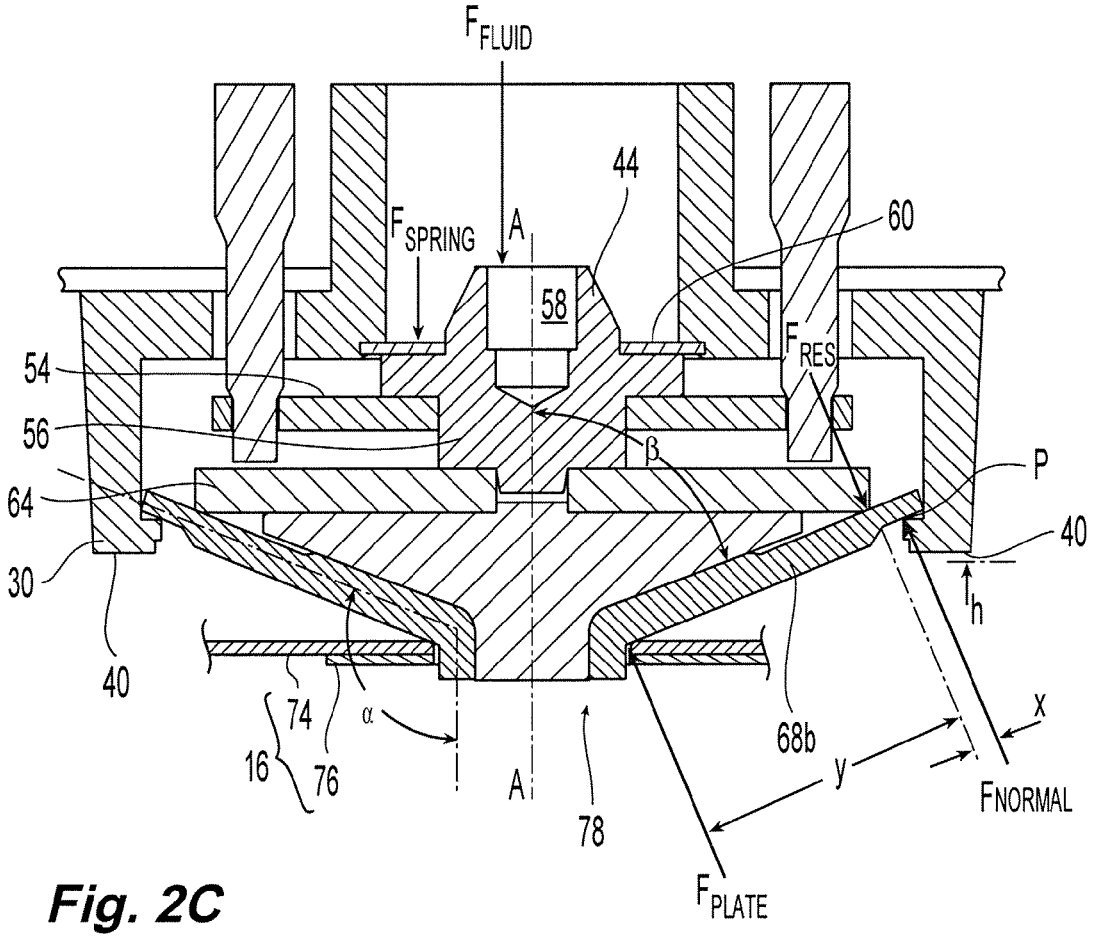
FIG. 2C is partial detailed cross-sectional view of a trigger, deflector and cover plate assembly for use in a preferred concealed sprinkler.
Figure 2D:
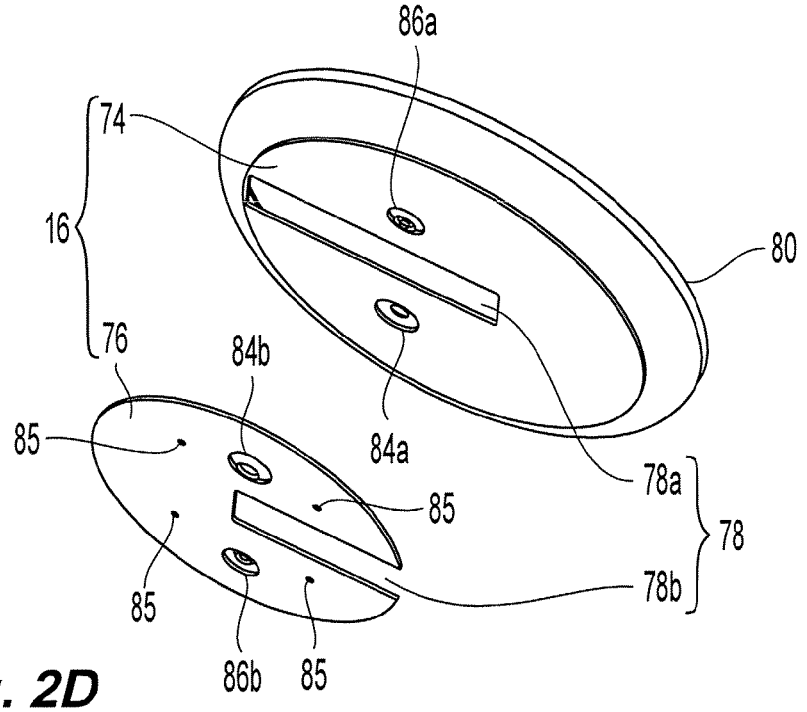
FIG. 2D is an exploded view of a preferred cover plate assembly for use in the concealed sprinkler in FIG. 2.
Figure 2E:
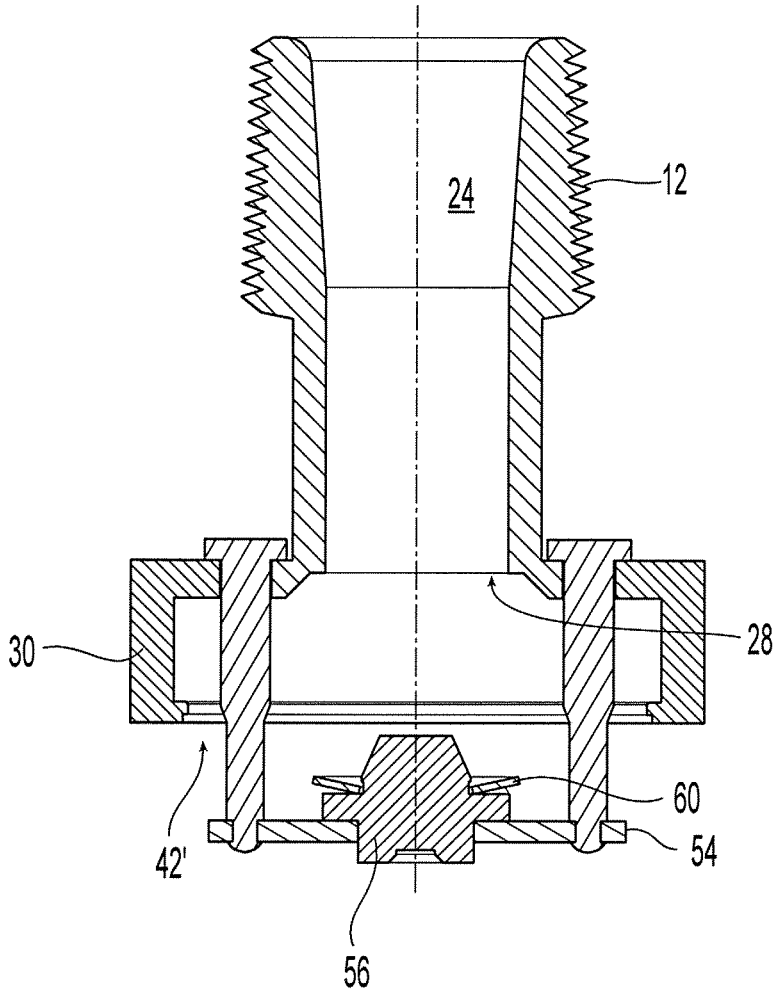
FIG. 2E is a partial cross-sectional view of the sprinkler assembly of FIG. 2 in an actuated position.

The axial travel of the arms 48*a*, 48*b* locates the deflector plate 54 to at least a second position distal of its first position and preferably distal of the distal opening 42 as seen, for example, in FIG. 2E. With the deflector plate in its second position, the closure element 44 is preferably spaced from the outlet 28 so as to permit any fluid (liquid or gas) supplied to the body 12 of the sprinkler 10 to discharge from the outlet 28. Liquid discharged from the outlet 28 can impact the axially displaced deflector plate 54 for distribution about an area beneath the sprinkler. To facilitate a distribution of fire fighting fluid in an area being protected by the sprinkler 10, the deflector plate 54 can include a pattern of closed or open ended slits, slots, through holes, openings, cut-outs or any combination thereof to satisfy any one of a vertical or horizontal fluid distribution test. Preferably the sprinkler body 12 and deflector assembly 14 can be configured to satisfy the residential sprinkler fluid distribution requirements under one or more of UL 199 (2004), UL 1626 (2004), NFPA-13 (2007), NFPA-13D (2007) and NFPA-13R (2007) or their respective later versions. The deflector plate 54 is preferably a pendent style deflector plate as generally shown, for example, in the deflector embodiments of FIGS. 4, 5A, and 6A.

Referring to FIGS. 2 and 2A, the sprinkler 10 is preferably a thermally actuated sprinkler so as to permit the passage of fluid from the outlet 28 in the presence of a sufficient amount of heat. Accordingly, the sprinkler 10 includes a trigger assembly 62 which supports the closure assembly 44 in the sealed position and releases the closure assembly in the presence of a fire. In one preferred embodiment of the sprinkler 10, the trigger assembly 62 preferably includes a bridge element 64 and a lever assembly 66. The bridge element 64 preferably includes a surface for supporting the deflector assembly 14 in its first position and the closure element 44 in its sealed position engaged with the outlet 28. More preferably, the bridge element 64 engages the closure element 44 preferably by a set screw 45 threaded in a planar portion of the bridge 64 and engaged with the partial bore of the closure element 44.

Figure 3B:
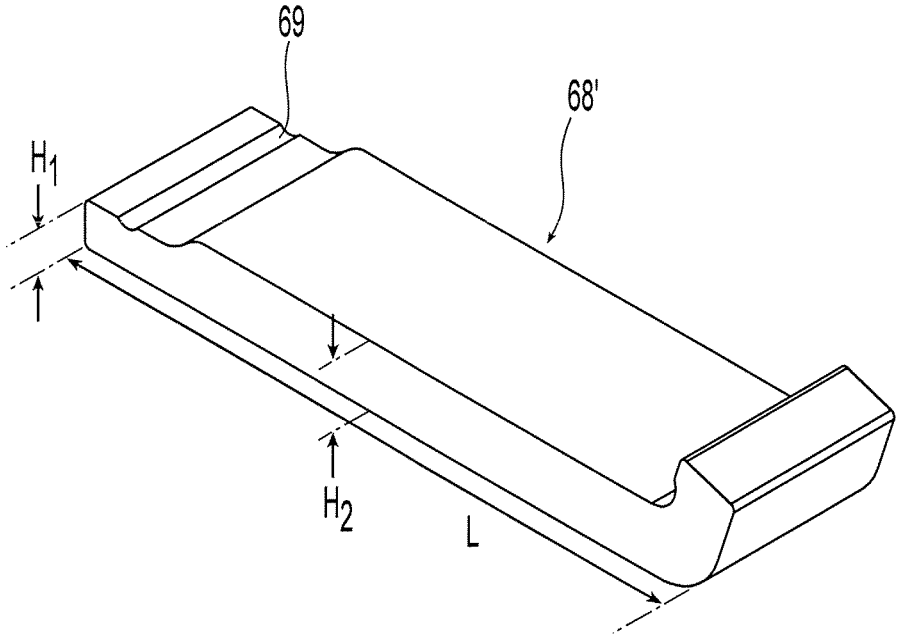
FIG. 3B is preferred embodiment of a lever for use in the sprinkler of FIG. 1.

To locate the deflector assembly 14 in the first position and the closure element in the sealed position, the bridge element 64 is appropriately axially located within the chamber 38. To appropriately locate the bridge element 64, the bridge element 64 is preferably supported by the lever assembly 66, which is further preferably in pivoted engagement with a shelf 70 formed along the inner surface 36 of the annular wall 30. The lever assembly 66 includes a pair of single lever members 68*a*, 68*b*. A preferred lever member, is shown for example in FIG. 3B, and it includes one end portion for engaging the shelf 70 and another end portion for engaging the cover plate assembly 16.

Referring to FIGS. 2 and 2B (spacing member 17 not shown in FIG. 2B for purpose of clarity), the engagement of the lever members 68*a*, 68*b* with the cover plate assembly 16 forms an angled frame member for directly and indirectly supporting the bridge element 64, closure element 44 and deflector assembly 14. The bridge element 64 preferably defines a channel 72 to receive the end portion of the lever member 68 so as to be straddled about the end of the lever member 68. Accordingly, the bridge element 64 is preferably trenched, grooved, and/or bracketed to resemble a U-shaped in cross-section. Alternatively, the bridge element can be a substantially single planar member for planar contact engagement with the components of the deflector and lever assemblies 14, 66. The bridge element 64 can define a length so as to bridge the lever members 68*a*, 68*b* at a location that locates the deflector assembly 14 in its first position and further locates the closure element 44 in its sealing position. More specifically, the length of the bridge element defines the point of contact on the lever members 68*a*, 68*b* for transferring the load of biasing element 60 and further transferring any applied static fluid load in the passageway 24 to the trigger assembly 62. Upon actuation of the sprinkler 10, the lever members 68*a*, 68*b* pivot about the point of engagement with the shelf 70, and thereby axially displacing the bridge element 64 so as to permit the axial translation of the deflector assembly 14 and the closure element 44.

The assembly sprinkler 10 is preferably pressure rated to maintain a static fluid pressure of about 500 pounds per square inch (psi). More specifically, the arrangement of the lever assembly 66 is configured to maintain the deflector assembly 14 in the first position and the closure element 44 in the sealed position within the outlet 28 under a static fluid pressure load of up to 500 pounds per square inch (psi). Therefore, provided the lever members 68*a*, 68*b* are restrained from pivoting about their engagement points with the inner surface 36 of the annular wall 30, the arrangement of the lever members 68*a*, 68*b* provides a frame structure sufficient to independently maintain the initial and sealed positions of the deflector assembly 14 and the closure assembly 44. Shown in FIG. 2C, is a cross-sectional view of the lever and cover plate assemblies 66, 16 overlaid by a static force diagram showing the manner in which the forces about the lever assembly 16 support the closure assembly 44 in the sealed position. More specifically shown is a fluid force $F_{fluid}$ and spring force $F_{spring}$ respectively applied in a distal direction by a fluid (gas or liquid) and a preferred Belleville spring disc 60. The fluid force $F_{fluid}$ and a spring force $F_{spring}$ can be distributed about the bridge element 64 and the further characterized by distributed resolved forces $F_{res}$ applied at each end of the bridge element 64 acting in a distal direction, as shown for example, upon the lever member 68*b*. Preferably the resolved force $F_{res}$ is preferably determined by:

$$F_{res}=[(F_{fluid}+F_{spring})/2]*\sin\beta$$

where $F_{fluid}$ is equal to the pressure of fluid multiplied by the area at the inlet 26, i.e. $F_{fluid}$=Pressure*[(Π/4)*Dia.$^2$], and β is the angle formed between the longitudinal axis A-A and the lever member 68*b*.

In addition to the resultant force $F_{res}$, a normal force $F_{normal}$ acts on the lever member 68*b*, for example, by the friction engagement of the lever member 68*b* with the shelf 70 at the point P. These forces tend to bias and pivot the lever member about the point of engagement P, which results in a bias force transferred by the lever members 68*a*, 68*b* against the cover plate assembly 16 at the edges forming the plate assembly opening 78 seen in FIG. 2C. In order for the lever member 68*b* to support the bridge element 64 and hold the closure element 44 in its sealing position, the lever member 68*b* must be a static member. Accordingly, in response to the outward biasing force, the plate assembly 16 exerts an equal and opposite reaction force $F_{plate}$ applied to the end of the lever member 68*b*. More specifically, the lever member 68*b* is static in its sealing configuration, and thus, the moments M about the point P at which the lever member 68*b* engages the shelf 70 must sum to zero. Looking at the location of the forces acting on the lever member 68*b* while in its static position engaged with the shelf 70 and the plate assembly 16, a moment equation can be derived and the plate assembly reaction force $F_{plate}$ can be solved for as follows. From static mechanics, $M_P=F*d$ where M is moment about a point P, F is an applied force, and d is the orthogonal distance between the direction of the force F to the point P. For the lever member 68*b* the moment equation can be written as:

$$\Sigma M_P=F_{Normal}*d1+F_{Res}*d2+F_{Plate}*d3 \text{ where}$$

d1, d2, d3 are respectively the orthogonal distances from the direction of the respective forces $F_{Normal}$, $F_{res}$, and $F_{plate}$ to the engagement point P preferably at the shelf 70, where further d1=0
d2=x
d3=y In the static situation where the lever members 68*a*, 68*b* are supporting the bridge and closure elements 64, 44 the total moment $\Sigma M_P$ for each lever member about the engagement point P equals zero and the reaction force required of the plate assembly can be determined as follows;

$$\Sigma M_P=0=F_{Normal}*0+F_{Res}*x+F_{Plate}*y$$

$$0=F_{Res}*x+F_{Plate}*y$$

applying a sign convention in which a force acting clockwise about a point P is negative and then solving for $F_{Plate}$ $$0=F_{Res}*x+(-F_{Plate})*y$$

$$F_{Plate}*y=F_{Res}*x$$

$$F_{Plate}=F_{Res}*x/y$$

Preferably for the sprinkler 10, the bridge element 64, lever assembly 66 and plate assembly 16 are configured and assembled to locate and direct the forces $F_{Normal}$, $F_{res}$, and $F_{Plate}$ such that the $F_{res}$ is applied in a direction orthogonally spaced at a distance x from the point P of about 0.05 inches, preferably 0.044 inches, and that the plate assembly or link force $F_{Plate}$ is applied in a direction orthogonally spaced at a distance y from the point P of about 0.4 inches and more preferably about 0.412 inches. Thus, where for example, the sprinkler 10 is uninstalled, no fluid force, i.e., $F_{fluid}=0$ and the only force transmitted to the link assembly 66 is the biasing spring force $F_{spring}$ of about eighty pound force (80 lbs.) from the spring disc and the angle β is about 68°, the resolved force at one lever member $F_{res}$ is thus [(80 lbs)/2]*sin (68) or about 37 lbs. and the plate assembly reaction force $F_{Plate}$ is $$F_{Plate}=37 \text{ lbs.}*0.044 \text{ in.}/0.412 \text{ in}$$

$$F_{Plate}\approx 4 \text{ lbs.}$$

Where the sprinkler 10 is installed having an inlet diameter Dia of about 0.441 inches and under a fluid (liquid or gas) working pressure of up to about 175 psi., adding the 4 lbs. of reaction for force due to the spring with the reaction force due to the working fluid pressure, the plate assembly reaction force $F_{Plate}$ is $$F_{Plate}=[F_{fluid}*\sin 68]*0.044 \text{ in.}/0.412 \text{ in}+4 \text{ lbs.}$$

$$F_{Plate}=[175 \text{ psi.}*(\Pi/4)*(0.441 \text{ in.})^2)/2*\sin 68]*0.044 \text{ in.}/0.412 \text{ in}+4 \text{ lbs.}$$

$$F_{Plate}\approx 1.3 \text{ lbs.}+4 \text{ lbs.}$$

$$F_{Plate}\approx 5.3 \text{ lbs.}$$

Thus for two levers, the total plate assembly reaction force $F_{PlateTotal}=2*5.3\approx 10.6$ lbs. in response to a total force $F_{Total}$ applied to the sprinkler, $F_{fluid}$ and $F_{spring}$ respectively being about 80 lbs. and 26 lbs. or a total of about 106 lbs. Therefore, the sprinkler 10 and its cover plate assembly 16 is preferably configured to define a load to reaction force $F_{PlateTotal}$ ratio ($F_{Total}$:$F_{Plate\ Total}$), where $F_{Total}=F_{Fluid}+F_{spring}$, ranging from about 5:1 to about 20:1, preferably from about 8:1 to about 12:1 and more preferably about 10:1.

Figure 2F:
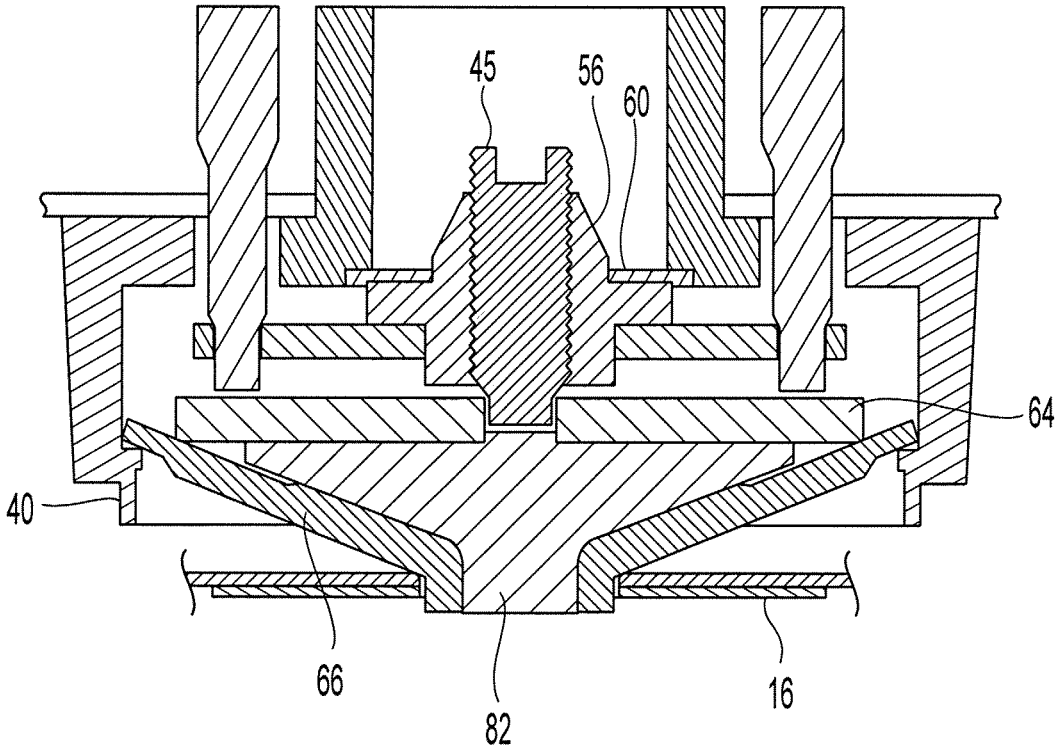
FIG. 2F is a partial cross-sectional view of a trigger, deflector and cover plate assembly for use in a preferred concealed sprinkler.

Referring again to FIGS. 2 and 2B, disposed between the lever members 68*a*, 68*b* is a retaining member or plug 82 having a recess for holding or housing the set screw 45 which is engaged with the bore 58 of the button 44. During assembly and with the internal components in place, the set screw 45 is accessed from the distal end of the sprinkler for loading and setting of the closure assembly 44 in the sealed position. The set screw 45 is accessed via the opening 78 in the plate assembly 16. The opening 78 is in communication with the passageway of the plug 82 which leads to the set screw 45 and its tool engagement end. Threading of the set screw advances the set screw 45 axially through the threaded opening in the bridge 64 to abut the button bore 58 and load the sprinkler 10. In an alternate embodiment as se en, for example, in FIG. 2F, the sprinkler is loaded by accessing the set screw through the passageway 24 of the sprinkler body. In the alternate embodiment the screw 45 is threaded into the closure element and abuts the plug 82 through the bore of the bridge 64 to load the sprinkler 10.

The cover plate assembly 16, as seen in FIG. 2D, preferably includes a first plate member 74 and a second plate member 76 coupled to the first plate member 74 to further form a trigger assembly as previously described. The cover plate assembly 16 is also configured to provide means for concealing from view the components of the sprinkler 10 container within the chamber 38 such as, for example, the deflector plate 54 or the lever members 68*a*, 68*b*. The first plate member 74 preferably includes a substantially planar surface portion that is sized so as to substantially cover the distal opening 42 of the body 12.

The second plate member 76 is preferably coupled to the first plate member 74 to further preferably define the cover plate assembly opening 78 which further preferably engages the ends of the lever member 68 in a close fit relation with the plug 82. The opening 78 preferably defines an opening length of about 0.25 inches. The first plate member 74 preferably includes a substantially planar surface portion sized so as to substantially cover the distal opening 42 of the body 12. An out of plane, raised or lip portion 80 of the first plate member 74 is contiguous and more preferably integral with the planar surface portion. The raised or lip portion 80 defines a height or depth of the cover plate assembly 16 sufficient to properly engage the spacing member 17 and the cover plate assembly 16. The raised or lip portion 80 preferably defines a substantially circular perimeter of the plate member 74. Alternatively, the lip portion 80 can define a perimeter of an alternate geometry such as, for example, oval, rectangular or polygonal. The lip portion 80 further has a diameter of a sufficient length so as to further define a circumference larger than the circumference of the distal opening 42. The lip portion 80 presents a continuous outer surface. Alternatively, the lip portion 80 may include periodic gaps or slots of a sufficient frequency to define the lip portion. Thus, the engagement of the annular ring 17 with the cover plate assembly 16 preferably locates the first plate member 74 coaxially and distally adjacent the distal opening 42 of the body 12 with the lip portion 80 axially below and clear of the openings 19 of the spacer, for example, annular ring 17.

The second plate member 76 is preferably coupled to the first plate member to further define the one or more cover plate assembly openings 78 which engage the ends of the lever members 68*a*, 68*b*. More specifically, shown in the exploded views of FIG. 2D is the cover plate assembly 16. The first plate member 74 includes an opening 78*a*, and the second plate member 76 includes a plate opening 78*b*. In one preferred assembly, the opening 78*a* of the first plate member 74 is an elongated closed formed opening, and the opening 78*b* of the second plate member is an open ended slot. Upon the assembly and overlap of the first and second plate members 74, 76, the respective opening and slot 78*a*, 78*b* cooperate to form the preferred closed form elongated single opening 78 as seen, for example, in FIGS. 1 and 2. The first and second plate members 74, 76 can include additional or alternatively dimensioned open or closed formed openings, cutouts, slots, slits, voids, perforations or depressions as shown in subsequent figures.

The opening 78 is preferably dimensioned such that ends of the levers 68*a*, 68*b* engage the axial ends of the opening 78 so as to locate the lever members 68*a*, 68*b* within the chamber 38 to support the deflector and closure assemblies as described above. Although, the openings of the cover plate assembly 16 are shown as substantially rectangular, other geometries are possible such as, for example, oval or another polygonal shape provide the opening can be engaged with the ends of the lever member in a substantially close fit arrangement. Preferably, the plate engaging ends of the lever members 68*a*, 68*b* are configured so as to engage the plate assembly opening 78 in a substantially normal direction to the surface of the plate assembly 14. The opening 78 is preferably located centrally to the cover plate assembly, thereby angling the lever members 68*a*, 68*b* relative to one another to form the supporting frame for the bridge element 64 and the deflector and closure assemblies as described above. More preferably, the opening 78 is located about the center of the cover plate assembly 16 and intersecting the longitudinal axis A-A such that the ends of the lever members 68*a*, 68*b* are located within the axial flow path defined by the outlet 28 of the passageway 24.

The ends of the lever members 68*a*, 68*b* preferably occupy only a portion of the entire area of the opening 78, for example, 30 to 50 percent of the entire available space defined by the opening 78. Thus to fully occupy the opening 78, provide the close fit between components and maintain the concealed nature of the complete sprinkler assembly with the retaining member or plug 82 to horizontally space the ends of the lever member 68*a*, 68*b* into close engagement with the ends of the opening 78. The central plug 82 can be alternatively embodied as a small resilient member for installation into the plate assembly opening 78 after locating the plate assembly 16 about the distal portion of the body 12.

The first and second plate members 74, 76 are preferably coupled together by a fusible thermally sensitive material such as, for example, a eutectic solder material rated to melt in the presence of sufficient heat generated by, for example, a fire event. Accordingly, the trigger assembly 62 preferably incorporates or includes the cover plate assembly 16 as a thermally rated link device to thereby define the thermal rating of the sprinkler. Thus, the preferred trigger assembly eliminates the need for separate cover plate and trigger assemblies to provide a thermally actuated concealed sprinkler. Preferably, the cover plate assembly 16 is configured to define a thermal rating for the sprinkler 10 ranging between 140° F. and 212° F.; more preferably, the sprinkler 10 is thermally rated for 165° F. In addition, the cover plate assembly 16 can be configured as a standard response or a fast response link device. Preferably, the solder material and the link device define the preferred response time index (RTI) of less than 50 $(m\text{-}s)^{1/2}$.

Referring to FIG. 2D, disposed between the first plate member 74 and the second plate member 76 is the solder material. The area to be soldered is preferably equivalent to the area defined by the surface area of the second plate member 76 to be joined to the first plate member 74. Accordingly, for a preferred second plate member 76, as shown for example in FIG. 2A, the areas to be soldered is about 0.4 square inches ($in.^2$) to about 0.5 $in^2$ and is preferably about 0.45 $in.^2$. In order to ensure that the solder coupling between the plate members is of an appropriate thickness, at least one of the plate members, preferably the smaller second plate member 76, includes one or more dimple members 85 that project into the space between the plate members 74, 76 at a preferred dimple height of about 0.0010 inches to about 0.0015 inches. The dimple members 85 act as a spacer between the plates as the solder material fills the interstitial space to control the thickness of the solder preferably to height equivalent to the dimple height. Accordingly, the preferred plate assembly 16 defines a weld area to height ratio ranging from about 300:1 to about 450:1.

To further ensure that the surfaces of the plate members 74, 76 are correctly oriented relative to one another so as to properly define the one or more cover plate assembly openings 78, each of the first and second plate members 74, 76 preferably includes a depression or opening 84*a*, 84*b* and a corresponding projection 86*a*, 86*b* for respectively containing therebetween the thermally sensitive material. The cooperation between the depressions 84 and the projections 86 ensures that the second plate member 76 is properly oriented and engaged with the first plate member 74 to define the plate opening 78 for engagement with the ends of the lever assembly. More preferably, the depressions 84 and the projections 86 are offset relative to the center point of each plate member 74, 76 to further ensure that the appropriate mating faces are engaged. Alternatively, other mating features can be incorporated respectively into the first and second plate members 74, 76 to ensure proper orientation and engagement of the plate members.

The first and second plate members 74, 76 of the assembly 16 are preferably copper, and in their preferred assembly, the plates 74, 76 are cleaned and de-oxidized. With an appropriate flux applied to their mating surfaces, the plates are pressed together and a preformed pellet of sufficient volume, preferably cylindrical in shape, is disposed within each cavity formed by the engaged depressions 84 and projections 86 to produce a solder fillet around the perimeter of the second plate member 76. The solder pellet is preferably a material of Indalloy 158 from INDIUM CORP. or equivalent solder having a preferred composition of 50% Bi, 26.7% Pb, 13.3 Sn, and 10% Cd.

Upon exposure to a sufficient level of heat, the thermally sensitive material between the plates melts thereby allowing the first and second plate members 74, 76 to separate, and allow the lever assembly to pivot and actuate the sprinkler 10. The first plate member 74 preferably defines a larger surface area than the second plate member 76. Where each of the first and second plate members 74, 76 or their assembly is substantially circular, the second plate member 76 is preferably located eccentrically relative to the first plate member 74 such that the center points of the first and second plate members 74, 76 are coaxially aligned along an axis skewed relative to the longitudinal axis A-A. Alternatively, each of the first and second plate members 74, 76 can define a center point, which can further be coaxially aligned in the cover plate assembly 16 and substantially parallel to the longitudinal axis A-A. Further alternatively, the cover plate assembly 16, can define a geometry other than substantially circular, such as, for example, oval, rectangular or polygonal.

The thermal performance of the cover plate assembly 16 as a thermal link device can be further defined by the material and thickness of the material forming the individual plate members 74, 76 of the assembly 16. Preferably, the thickness of the first and second plate members 74, 76 is such that the cover plate assembly 16 presents a sufficiently rigid and durable structure yet provides the desired thermal response in the assembly. Accordingly, the first and second plate members can be constructed of any material of any thickness provided the assembly of the first and second plate members provides adequate thermal responsiveness.

Preferably, all the exposed surfaces of the cover plate assembly 16 are coated to protect the assembly against corrosion from the elements of the surround environment in which the sprinkler 10 may be placed. The cover plate assembly 16 is covered with a coating to satisfy one or more standards and test protocols, such as for example, the operation and corrosion test standards under UL Standard 199. Such a two-part coating is well known in the art. Alternatively, the cover plate assembly 16 can be coated with a polyester coating which is preferably configured as a powder applied paint. Further in the alternative, a protective coating may be applied in which the coating is embodied in an epoxy coating. Other coatings know in the art may also be utilized. More preferably, the cover plate assembly 16 is covered with a paint coating to satisfy one or more standards and test protocols, such as for example, the operation and corrosion test standards under UL Standard 199, which is incorporated by reference in its entirety. The preferred coating includes a prime coat, preferably a fast drying pretreatment type, 2 package, acid catalyzed vinyl washcoat such as, for example, INDUSTRIAL WASH PRIMER CC-A2 from SHERWIN WILLIAMS as described in Sherwin William Chemical Coating data sheet CC-A2 (11/06) available at Internet URL:<http://www.paintdocs.com/webmsds/webPDF.jsp?SITEID=STORECAT&prodno=03577743 5052&doctype=PDS&lang=E>. The preferred coating further includes a top coat of a corrosion inhibiting epoxy polyamide coating such as, for example, MILGUARD-53022 CORROSION INHIBITING L & C FREE EXPOXY PRIMER from SIMCO COATINGS INC., as described in Simco Mil Spec Paint data sheet Mil-P-53022 available at Internet URL:<http://www.simcocoatings.com/mil-p-53022b.html>. The coating is preferably applied to a thickness of ranging from about 0.0005 inches to about 0.002 inches.

Accordingly, the preferred coating combination provides a means to provide corrosion protection to the plate assembly 16 without interference to the link responsiveness, operation or separability of the plate members 74, 76. With regard to the ability of the plate members 74, 76 to separate upon proper thermal response, i.e., melting of the solder in the presence of a sufficient heat source, the coating preferably allows the plate members 74, 76 to separate when subject to a separation force of less than 6 lbs-force and preferably separate at 3 lbs-force. The link assembly 16 successfully satisfies the test upon complete separation of the plate members 74, 76 when subjected to a load of less than six pounds and preferably at three pounds.

As described above, the sprinkler 10 is preferably disposed within a mounting element or escutcheon 18 for flush mount installation against a ceiling surface. To install the sprinkler 10, the sprinkler 10 is preferably threaded into an appropriately sized tee-type or other pipe fitting that is preferably mounted along a branch supply line of a sprinkler system. To facilitate installation of the sprinkler 10, the outer surface of the 34 of the annular wall 30 preferably includes one or more tool engaging surfaces 87, as seen for example in FIG. 2B, radially disposed about the outer surface 34. A tool (not shown) having a plurality of planar projections is preferably provided for engagement with the tool engagements surfaces 87. The projections of the tool can engage the surfaces 87 to thread the sprinkler 10 into an installed position or alternatively to unthread the sprinkler for removal. In a preferred body of the sprinkler 10, shown for example in FIG. 2B, the tool engagement surfaces 87*a*, 87*b*, 87*c* are preferably radially spaced so as to be able to orient the arms 48*a*, 48*b* upon installation. Specifically, each the central axes of two engagement surfaces 87*a*, 87*b* passing through the center point of the sprinkler discharge end face are located forty degrees (40°) relative to the axis along which the through holes 46*a*, 46*b* are spaced such that the central axes are angularly spaced by 100°. The central axis of the third engagement face passes through the center point of the sprinkler end face perpendicular to the axis along which the through holes 46*a*, 46*b* are spaced so as to locate the third engagement face 87*c* at an angle of about 130° relative to each of the first and second engagement surfaces 87*a*, 87*b*. Because of the orientation of the engagement surfaces 87*a*, 87*b*, 87*c* are oriented relative to the through holes 46*a*, 46*b*, the tool can be used to orient or align the deflector assembly arms 48*a*, 48*b* relative to, for example, the branch or feed line of the sprinkler 10.

In another embodiment, as seen for example, in FIG. 2A, the tool engagement surfaces are formed along the proximal surface 32 of the annular wall 30 as two diametrically opposed tabs 87 disposed about and aligned with the arms 48*a*, 48*b*. One preferred method of installing the sprinkler 10 starts with installing the sprinkler body 12. An installation tool engages the opposed tabs 87 to secure the body 12 to the supply pipe. A preferred push-on escutcheon is disposed about the installed sprinkler body 12 to conceal the ceiling opening and because the annular wall 30 does not include the engagement surfaces about its outer surface, the sprinkler body 12 within the escutcheon 18 present a substantially continuous circular profile from the distal end of the sprinkler 10.

In service, a fluid (liquid or gas) pressure ranging from about 7 psi. to about 175 psi. is applied at the closure element 44 of the sprinkler 10. Higher pressures could be applied provided the cover plate assembly 16 and lever assembly 66 were appropriately sized and configured. The installed sprinkler 10 preferably operates by thermally activation of the trigger assembly 62. Operation of the trigger assembly 62 permits displacement of the deflector assembly 14 and the closure assembly 44 thereby allowing fluid, and preferably liquid, supplied to the inlet of the body 12 to be discharged from the outlet 28 of the passageway 24 and distributed upon impact with the deflector plate 54. More specifically, in the presence of a sufficient level of heat, the thermally sensitive material coupling the first and second plates 74, 76 of the cover plate assembly melts. Unable to resist the biasing force exerted by the pivot of the lever members 68*a*, 68*b*, the second plate member 76 separates from the first plate member 74. With the second plate member 76 displaced or removed, the cover plate assembly opening 78 is enlarged to the exposed first plate opening 78*a*. As a result, the first plate member 74 is freed from the snap fit engagement with the lever assembly 62, and therefore first plate member 74 is separable from the distal portion 22 of the body 12. Without the restraint of engagement with the first and second plate members 74, 76, the lever members 68*a*, 68*b* are free to continue to pivot about their engagement point with the shelf 70 formed along the inner surface 36 of the annular wall 30. The pivot of the lever members 68*a*, 68*b* further preferably frees the lever members from engagement with the bridge element 64, and the lever members can be separated from the sprinkler assembly. Without the rigid support of the lever members 68*a*, 68*b* and the bridge element 64, the deflector plate assembly 14 and the closure element 44 are axially translated to the second position under the load of the fluid pressure, and fluid is permitted to flow through the passageway 24 for discharge out the outlet 28.

The trigger assembly 62 and/or the cover plate assembly 16 can be further altered to provided different embodiments of the sprinkler 10. Described below are varying configurations of the cover plate assembly opening 78 and arrangements of the bridge element 64 and lever assembly 66. Accordingly, where possible or not otherwise expressly excluded, the variations to the sprinkler body 12, deflector assembly 14, the escutcheon 18, lever assembly 66, closure assembly 44, cover plate assembly 16, other components and subcomponents, the various special relations, manner of assembly, and the manner of operation described are applicable to each of the various embodiments described throughout. Common terms are used throughout where applicable.

Referring again to FIGS. 4, 4C, 4A and 6A, the liquid discharged from the outlet 28 can impact the axially displaced deflector plate 54 for distribution about an area beneath the sprinkler. To facilitate a distribution of fire fighting fluid in an area being protected by the sprinkler 10, the deflector plate can include a pattern of closed or open ended slits, slots, through holes, openings, cut-outs or any combination thereof to satisfy any one of a vertical or horizontal fluid distribution test. Preferably the sprinkler body 12 and deflector assembly 14 can be configured for standard, extended, and/or residential coverage as defined by applicable sprinkler and installation standards, for example, UL 1626 (2008), UL 199 (2008), NFPA-13, 13D and 13R (2010). The deflector plate 54 is preferably a pendent style deflector plate as generally shown for example in FIG. 9.

Figure 4:
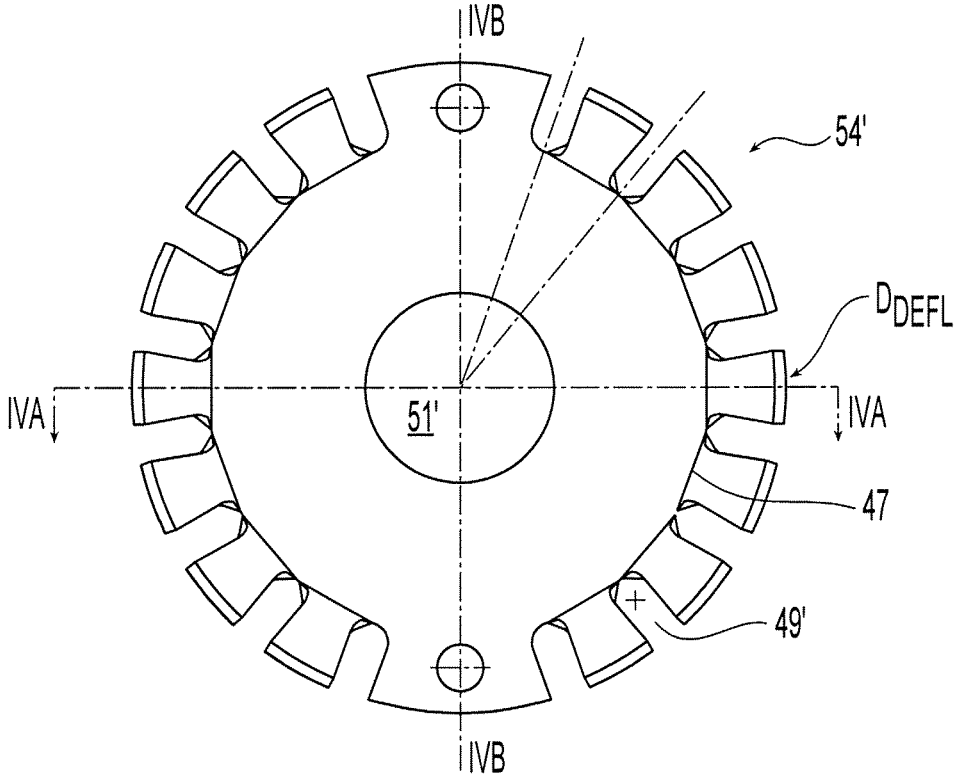
FIGS. 4, 4A, 4B & 4C is preferred deflector for use with the concealed sprinkler of FIG. 1.
Figure 4A:
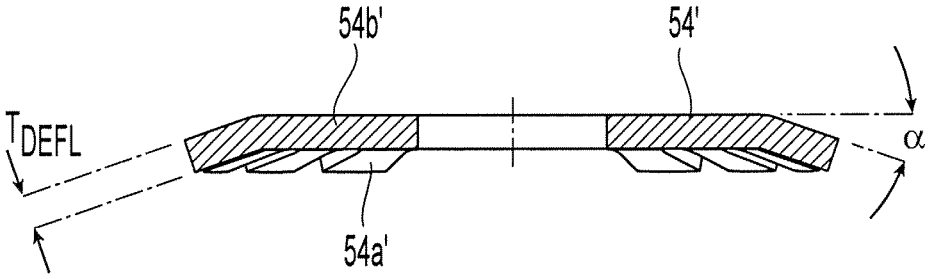
Figure 4B:
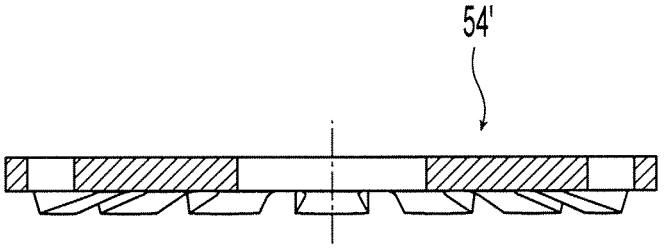

Shown in FIGS. 4, 4A and 4B is a preferred deflector plate 54' shaped for standard coverage when installed in the sprinkler 10'. The deflector 54' preferably defines a diameter $D_{DEFL}$ of about 1 inch and more preferably 0.96 inches and a thickness $T_{DEFL}$ of about 0.05 inches. The deflector includes a pattern of preferably open ended slots radially distributed about the peripheral edge of the deflector 54'. The deflector further includes a central hole 51' for receipt of the closing element 44' or closing butting 56'. Preferably, eight slots are equi-radially disposed to each side of an axis IVB-IVB running perpendicular to the axis IVA-IVA, and the sixteen slots are preferably geometrically identical. A preferred slot has a width of about 0.060 inches and extends to a slot depth to a slot terminal end located such that the center point of the preferred semi-circular slot terminal end is at a distance of about 0.4 inches from the center of the deflector 54'. The deflector 54' further includes a pair of diametrically opposed through holes aligned along the axis IVB-IVB for engagement with the distal ends 52' of the arms 48*a'*, 48*b'*. The centers of the through holes are preferably located so as to define a spacing therebetween of about 0.826 inches about the center point of the deflector 54'. The peripheral portion of the deflector 54' is bent to define a bend line 47 about the center point of the deflector 54'. The bend line 47 is substantially coincident with the terminal end of the slots. More preferably, the bend line 47 substantially defines a diameter of about 0.730 about the center of the deflector 54'. The bend in the deflector 54' defines a substantially concave surface 54*a'* and an opposite substantially convex surface 54*b'* as more specifically shown in FIG. 4A. The deflector 54' is preferably installed such that the convex surface 54*b'* faces the outlet 28'. The bend line is configured such that the tines extending between the slots preferably define an angle α of about nineteen degrees with the plane defined by the axes IVA-IVA and IVB-IVB.

Figure 4C:
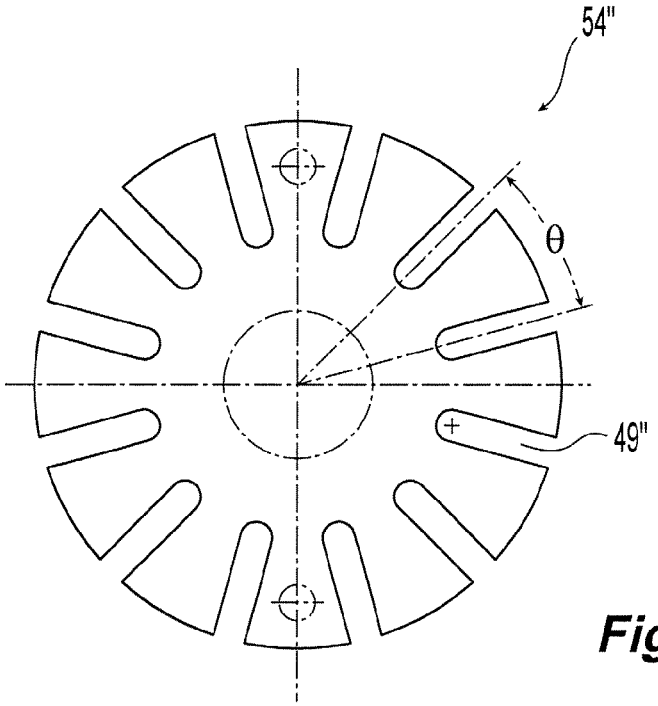

In an alternate embodiment, shown for example in FIG. 4C, the deflector 54' can be configured for extended coverage. More preferably, the deflector 54' is preferably a substantially flat or planar member defining a diameter of about 1.0 inch. The deflector 54' includes a pattern of preferably open ended slots radially distributed about the peripheral edge of the deflector 54'. More specifically, twelve open ended slots are equi-radially distributed about a central hole, which is configured for receipt of the closing element 44' or closing button 56'. Preferably, the slots are preferably geometrically identical, each having a width ranging of about 0.060 inches and extending to a slot depth such that the center point of the preferably semi-circular slot terminal end is at a distance of about 0.3 inches from the center of the deflector. The slots are preferably angularly spaced by an angle of about 30°. The deflector 54' further includes a pair of diametrically opposed through holes for engagement with the distal ends of the arms 48*a'*, 48*b'*. The centers of the through holes are preferably located so as to define a spacing of about 0.826 inches about the center point of the deflector 54'.

Figure 5A:
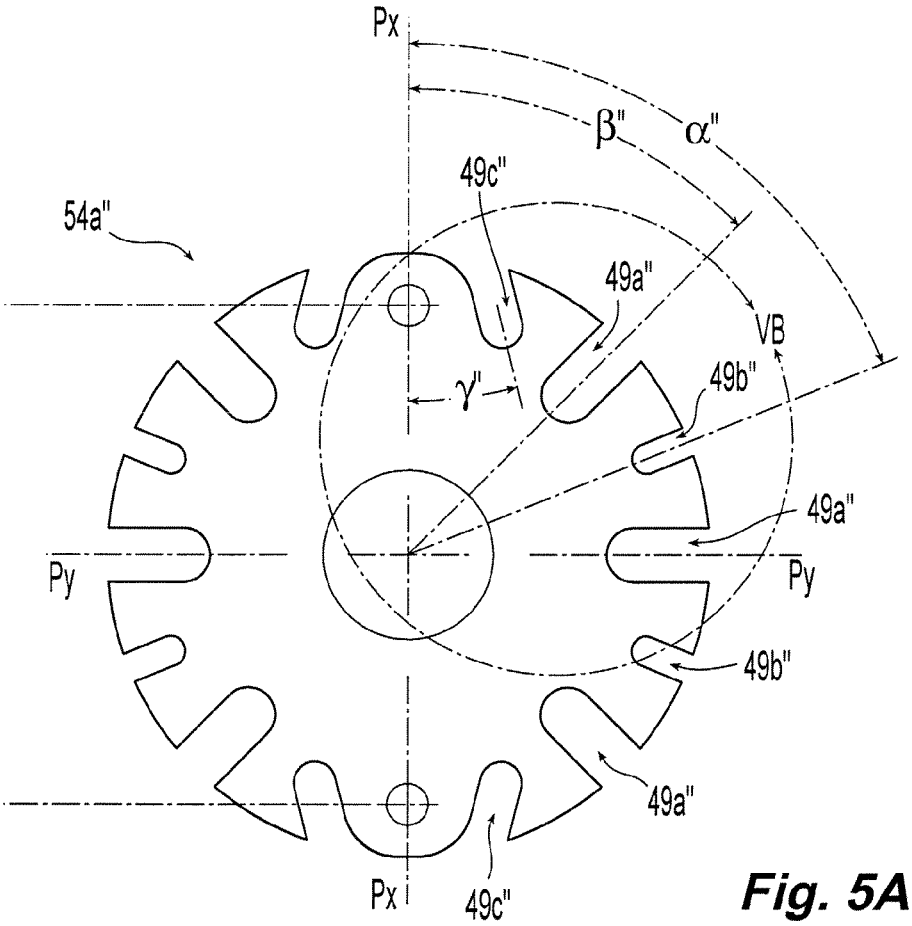
FIGS. 5A & 5B is another preferred deflector for use with the concealed sprinkler of FIG. 1.
Figure 5B:
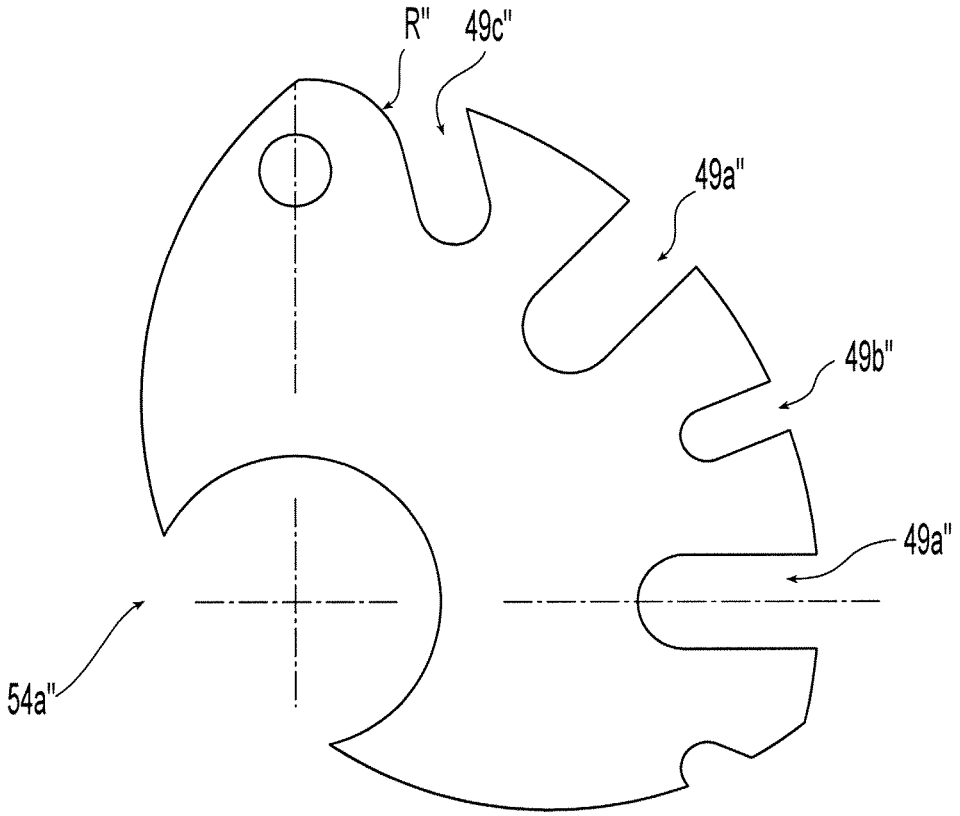

Shown in FIGS. 5A and 5B is an alternate embodiment of the deflector 54*a*" configured for extended coverage. The deflector 54*a*" is preferably a substantially flat or planar member defining a diameter of about 1.0 inch. The deflector 54*a*" includes a pattern of preferably open ended slots radially distributed about the peripheral edge of the deflector 54*a*". More specifically, fourteen open ended slots are equi-radially distributed about a central hole, which is configured for receipt of the closing element 44' or closing button 56'. Preferably, the slots define at least three groups of slots of varying length and width. Each slot of one group of slots 49*a*" preferably provides for a slot width of about 0.090 inches that extends to a slot depth where the center point of the preferably semi-circular slot terminal end is at a distance of about 0.373 inches from the center of the deflector. The slots 49*a*" of the first group preferably have slot axes that intersect the center point of the deflector. The first group of slots 49*a*" preferably includes six slots with three slots disposed to each side of the deflector axis Px-Px, in which the three slots are angularly spaced apart by an angle β" of about 45°.

Each slot of a second group of slots 49*b*" preferably provides for a slot width of about 0.050 inches that extends to a slot depth where the center point of the preferably semi-circular slot terminal end is at a distance of about 0.425 inches from the center of the deflector. The slots 49*b*" of the second group preferably have slot axes that intersect the center point of the deflector. The second group of slots 49*b*" preferably includes four slots with two slots disposed to each side of the deflector axis Px-Px, in which the two slots are angularly spaced apart by an angle of about 44° and in which each of the two slots are equi-radially spaced from the axis Px-Px by an angle α" of about 68°.

Each slot of a third group of slots 49*c*" preferably provides for a slot width of about 0.070 inches that extends to a slot depth of about 0.66 inches to the center point of the preferably semi-circular slot terminal end. The open end of the slot 49*c*" further preferably includes a peripheral edge extending from the axis Px-Px to define a radius of curvature R" of about 0.089 inches. The third group of slots 49*c*" preferably includes four slots with two slots disposed to each side of the deflector axis Px-Px, in which the slot axes of the two slots each define an included angle γ" of about 14° from the deflector axis Px-Px. The deflector 54*a*" further includes a pair of diametrically opposed through holes for engagement with the distal ends of the arms 48*a*', 48*b*'. The centers of the through holes are preferably located so as to define a spacing of about 0.826 inches about the center point of the deflector 54" along the axis Px-Px.

Figure 6A:
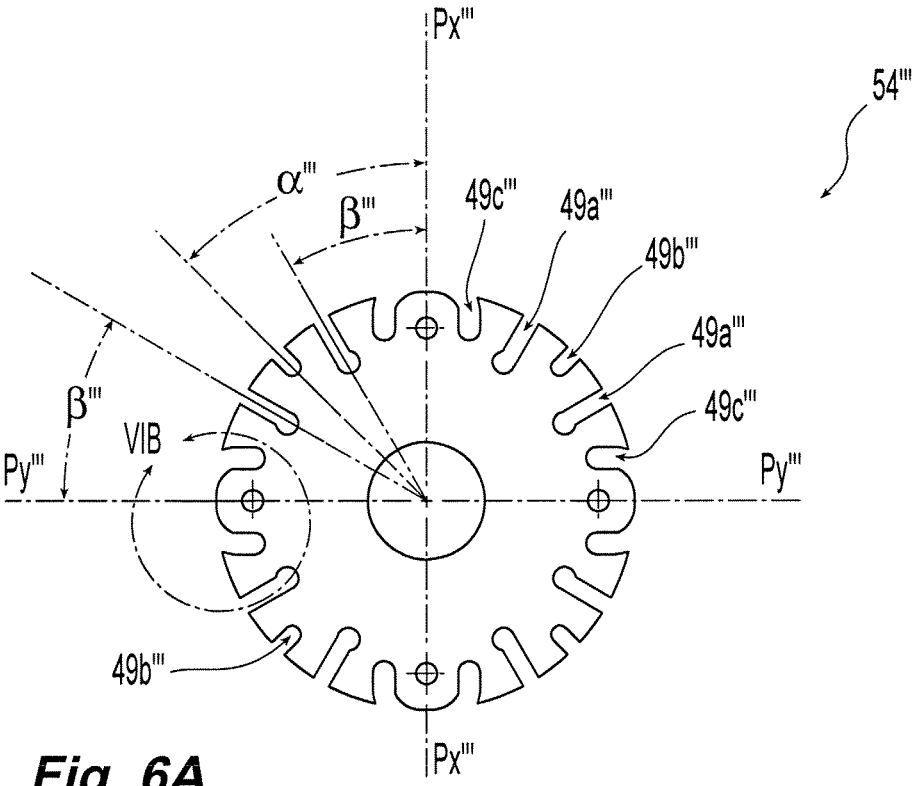
FIGS. 6A & 6B is another preferred deflector for use with another preferred embodiment of concealed sprinkler.
Figure 6B:
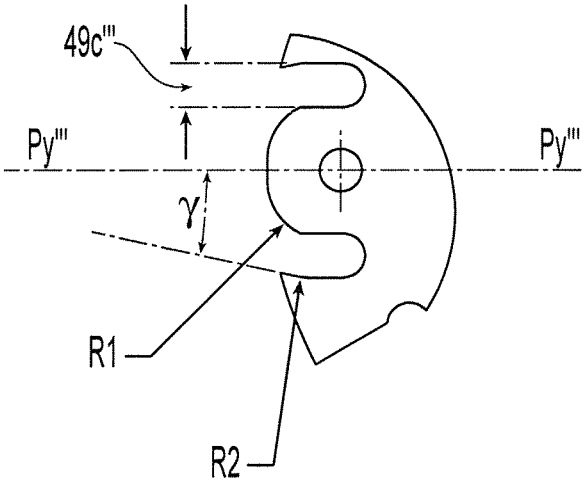

Shown in FIGS. 6A and 6B is a preferred deflector 54'" for use with the sprinkler 10'" having first and second pair of arms 48*a*"; 48*b*"; 48*c*"; 48*d*'" in the deflector assembly 14'. The preferred deflector 54'" is preferably a substantially flat or planar member defining a diameter of about 1.0 inch. The deflector 54'" includes a pattern of preferably open ended slots radially distributed about the peripheral edge of the deflector 54'. More specifically, twenty open ended slots are equi-radially distributed about a central hole, which is configured for receipt of the closing element 44' or closing button 56'. Preferably, the slots define at least three groups of slots of varying length and width. Each slot of one group of slots 49*a*'" preferably provides for a first slot width portion of about 0.042 inches that extends to a slot depth where the center point of the preferably wider circular slot terminal end is located about 0.319 inches from one of axes Px'"-Px'", Py'"-Py'" and 0.185 inches from the other of axes Px'"-Px'", Py'"-Py'". The slots 49*a*'" of the first group preferably have slot axes that intersect the center point of the deflector. The first group of slots 49*a*" preferably includes eight slots with four slots disposed to each side of the deflector axis Px'"-Px'", in which each of the four slots are angularly spaced from one of the axes Px'"-Px'", Py'"-Py'" by an angle β'" of about 30°.

Each slot of a second group of slots 49*b*'" preferably provides for an initial slot width of about 0.042 inches that extends to a slot depth where the center point of the preferably semi-circular slot terminal end is located about 0.319 inches from one of axes Px'"-Px'", Py'"-Py'". The slots 49*b*'" of the second group preferably have slot axes that intersect the center point of the deflector. The second group of slots 49*b*'" preferably includes four slots with two slots disposed to each side of the deflector axis Px'"-Px'", in which the two slots are angularly spaced apart by an angle of about 45° and in which each of the two slots are equi-radially spaced from the axis Px'"-Px'" by an angle α'" of about 45°.

Each slot of a third group of slots 49*c*'" preferably provides for a slot width of about 0.53 inches that extends to a slot depth where the center point of the preferably wider circular slot terminal end is located about 0.102 inches from one of axes Px'"-Px'", Py'"-Py'" and 0.410 inches from the other of axes Px'"-Px'", Py'"-Py'". The open end of the slot 49*c*'" further preferably includes an internal peripheral edge relative to one of one of axes Px'"-Px'", Py'"-Py'" to define a radius of curvature $R_1$ of about 0.070 inches. The open end of the slot 49*c*'" also preferably includes an outer peripheral edge relative to one of one of axes Px'"-Px'", Py'"-Py'" that defines an included angle of γ'" about 12° from the deflector axis Px'"-Px'", Py'"-Py'" continuous with a radius of curvature $R_2$ of about 0.060 inches. The third group of slots 49*c*'" preferably includes eight slots with four slots disposed to each side of the deflector axes Px'"-Px'", Py'"-Py'" in which the slot axes of the slots 49*c*'" run substantially parallel to one of the axes Px'"-Px'", Py'"-Py'".

The deflector 54'" further includes two pairs of diametrically opposed through holes that are disposed along axes Px'"-Px'", Py'"-Py'" for engagement with the distal ends of the arms 48*a*'"; 48*b*'"; 48*c*'"; 48*d*'" of a four arm or pin deflector assembly. The centers of the through holes are preferably located so as to define a spacing of about 0.826 inches about the center point of the deflector 54'" along the axes Px'"-Px'", Py'"-Py'".

Figure 11:
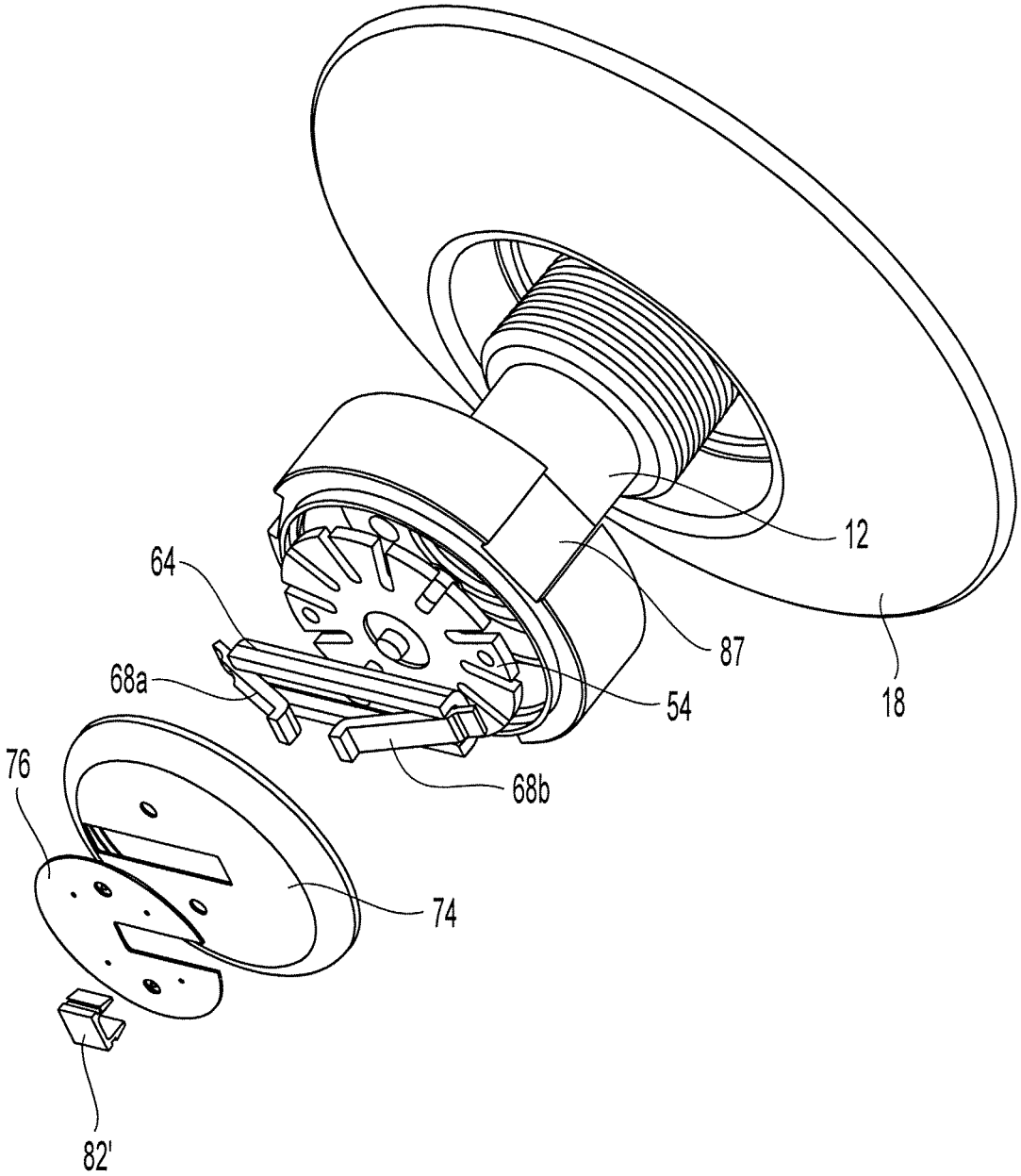
FIG. 11 is another embodiment of a trigger assembly for use in the sprinkler of FIG. 1.
Figure 12:
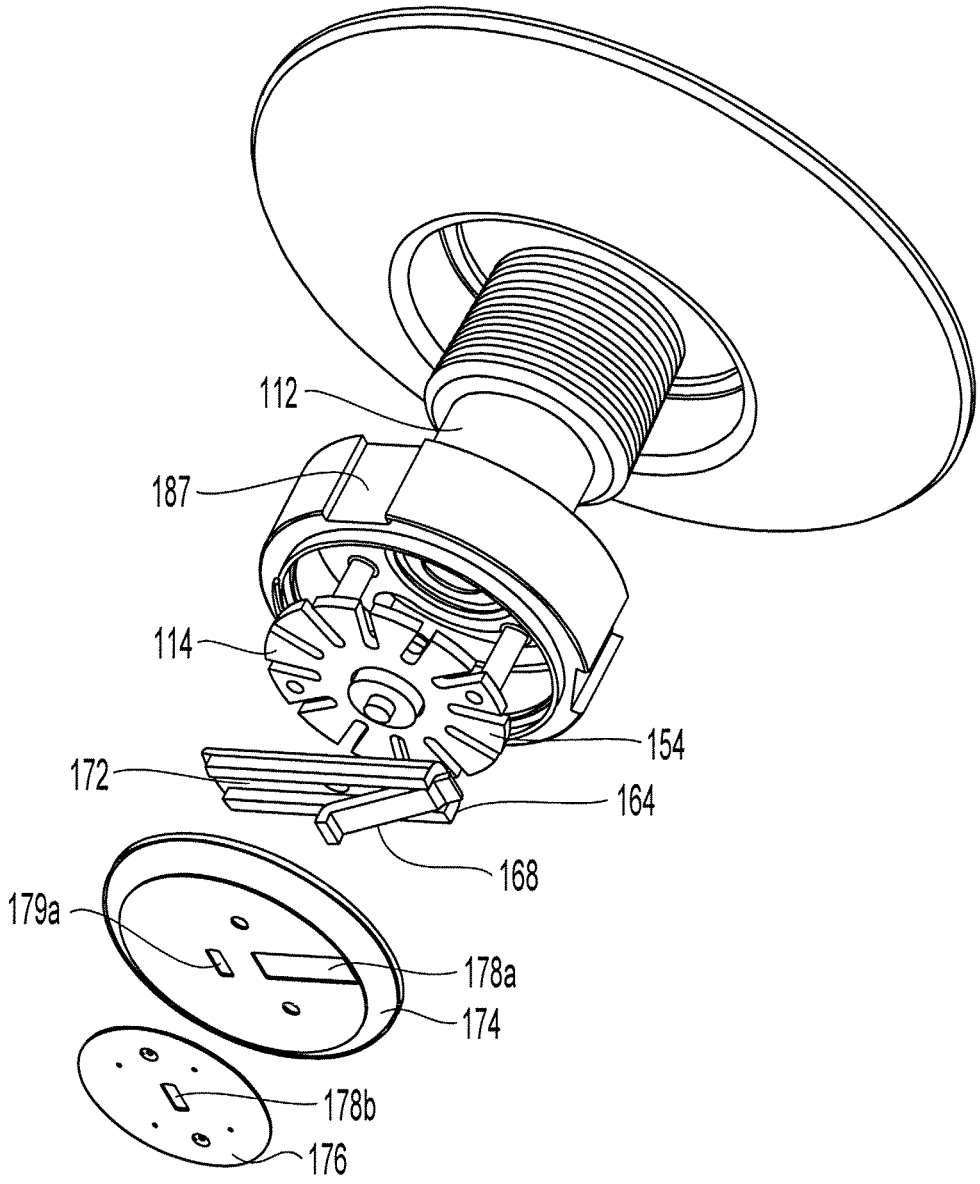
FIG. 12 is another embodiment of a trigger assembly for use in the sprinkler of FIG. 1.
Figure 13:
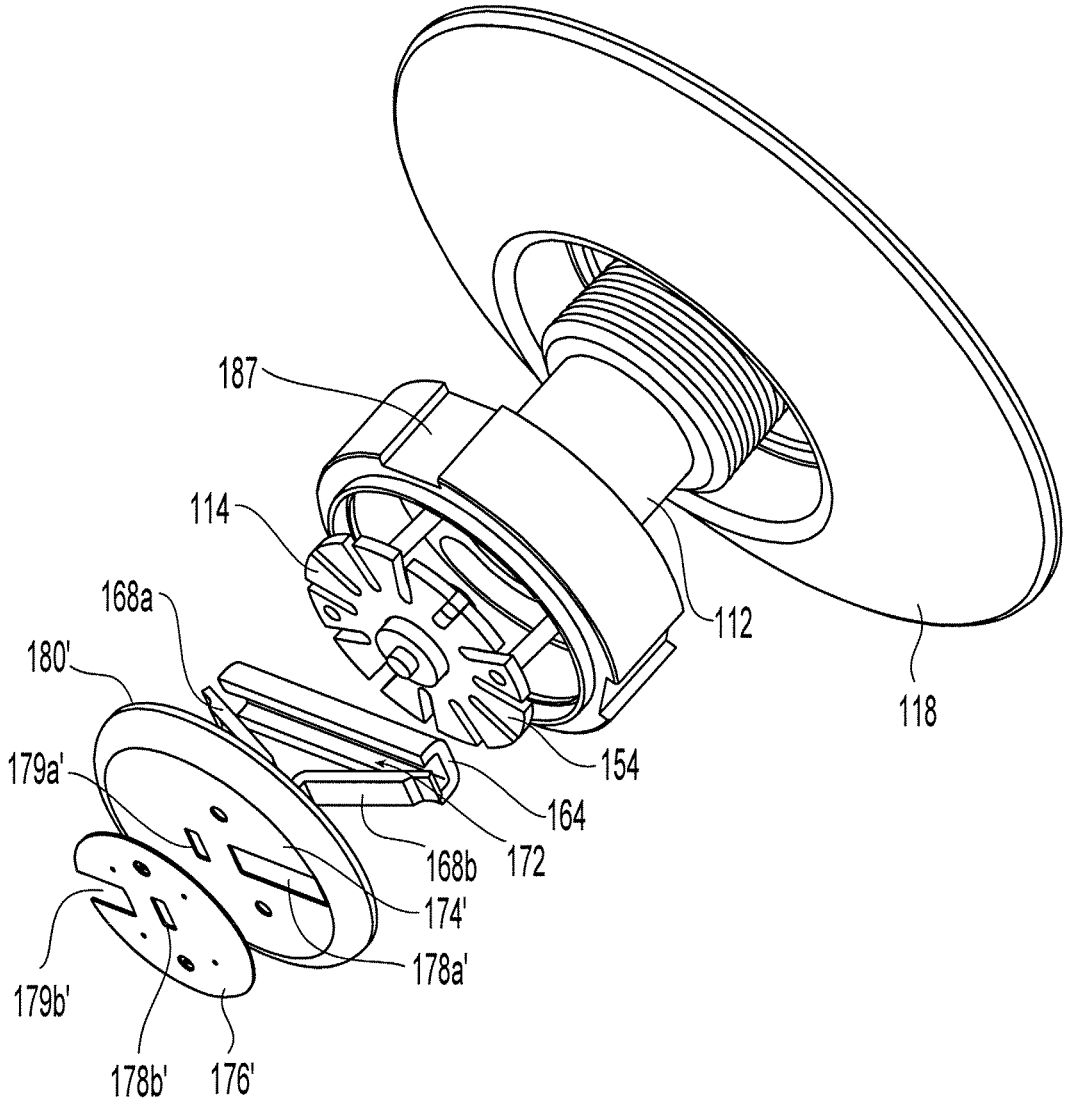
FIG. 13 is another embodiment of a trigger assembly for use in the sprinkler of FIG.

In alternate arrangements of the sprinkler shown in the partially exploded detailed views of FIGS. 11-13, the spacing member 17 has been left out for visual clarity. In the alternative embodiment of the sprinkler shown in FIG. 11, the ends of the lever members 68*a*, 68*b* are held close together in the central opening 78 with a central plug 82' inserted between the lever ends. The plug 82' shown in the alternative embodiment of the sprinkler 10, shown in FIGS. 3-3A is preferably a resilient two prong member for wedged engagement into the opening 78 adjacent the ends of the lever 68*a*, 68*b*. The prongs of the plug 82' are preferably configured with one or more surfaces to engage the internal surfaces of the first plate member 74 and prevent removal of the plug 82' from the opening 78.

Shown for example in FIG. 12 is another illustrative embodiment of the preferred sprinkler 10. The sprinkler 110 preferably generally includes a body 112, a deflector assembly 114 and a cover plate assembly 116. The sprinkler 110 also includes a trigger assembly 162. The trigger assembly 162 preferably includes a bridge element 164 and a lever assembly 166. To locate the deflector assembly 114 in the first position and the closure element in the sealed position, the bridge element 164 is appropriately axially located within the chamber 138. To appropriately locate the bridge element 164, the bridge element 164 is preferably cantilevered or supported at one end by an annular shelf 170 formed along the inner surface 136 of the annular wall 130, and the other end of the bridge element 164 is supported by the lever assembly 166, which is further preferably in pivoted engagement with the shelf 170. In one embodiment, the lever assembly 166 includes a singe lever member 168. The engagement of the lever member 168 with the cover plate assembly 116 forms an angled frame member for directly and indirectly supporting the bridge element 164, closure element 144 and deflector assembly 114. In addition, the spacing or ring member 17 is configured about its periphery to support the cover plate assembly 16 substantially perpendicular to the sprinkler longitudinal axis. Preferably, the ring member 17 is affixed to the distal portion of the sprinkler body 12. To support itself against the shelf 170, one end of the bridge element 164 forms a preferably right angle notch for engaging the shelf 170. The cover plate assembly 116 preferably includes a first plate member 174 and a second plate member 176 coupled to the first plate member 174. The second plate member 176 is preferably coupled to the first plate member 174 to further preferably define the cover plate assembly opening 178 which further preferably engages the end of the lever member 168 in a close fit relation. The first plate member 174 includes an opening 178*a*, and the second plate member 176 includes a plate opening 178*b*. The opening 178*a* of the first plate member 174 is an elongated closed formed opening, and the opening 178*b* of the second plate member is a shorter closed formed opening. Upon the assembly and overlap of the first and second plate members 174, 176, the respective openings

178*a*, 178*b* cooperate to form a closed single opening 178. The single opening 178 is preferably dimensioned to receive the end of the lever member 168 in a closed fit arrangement. Moreover, the opening 178 is preferably located substantially centrally to angle the lever member 168 and form the support frame for the bridge element 164 and the deflector and closure assemblies 114, 144 as described above. More preferably, the opening 178 is located about the center of the cover plate assembly 116 and intersecting the longitudinal axis A1-A1.

In an alternative embodiment of the preferred sprinkler as shown in FIG. 13, as sprinkler 110 having a trigger assembly 162' that includes a bridge element 174' supported by preferably two diametrically opposed lever members 168*a*, 168*b* disposed within the chamber 138. The bridge element 164 and the lever members 168*a*, 168*b* can be similarly constructed and similar to the bridge element 64 and lever members 68*a*, 68*b* as previously described with regard to the preferred sprinkler 10 shown in FIG. 2. The trigger assembly 162' also preferably includes an alternate embodiment of the cover plate assembly 116' that has two separate cover plate assembly openings 179', 178' for separate engagement with the ends of the two lever members 168*a*, 168*b*. As seen in FIG. 13, the cover plate assembly 116' preferably includes the first plate member 174' and the second plate member 176'. The first plate member 174' includes a first plate opening 178*a*' and a second plate opening 179*a*'. The second plate member 176' preferably includes a first plate opening 178*b* and a second plate opening 179*b*'. In the preferred embodiment of the cover plate assembly 116', the first opening 178*a*' of the first plate member 174' is an elongated closed form opening and the second plate opening 179*a*' is a shorter closed form slot. In the second plate member 176', the first plate opening 178*b*' is preferably also a closed form slot substantially similar to that of the second opening 179*a*' of the first plate member 174'. The second plate opening 179*b* of the second plate member 176' is preferably configured as an elongated open ended slot. Upon the assembly and overlap of the first and second plate members 174', 176', the respective openings and slots 178*a*', 178*b*', 179*a*', 179*b*' cooperate to form two preferably separate and closed form slot openings 178', 179'. As with the previously described cover plate assemblies, the first and second plate members 174', 176' can include additional or alternatively dimensioned open or closed formed openings, cut-outs, slots, slits, voids, perforations or depressions. The openings 178', 179' are preferably dimensioned such that the ends of the levers 168*a*, 168*b* engage openings 178', 179' so as to locate the lever members 168*a*, 168*b* within the chamber 138 to support the deflector assembly 114 in the first position and the closure assembly 144 in its sealed position within the outlet 128 without a plug member disposed between the lever members.

Each of the above described embodiments of the preferred sprinkler were shown as being configured for pendent installation. Alternatively, any of the above embodiments can be configured as a concealed sidewall sprinkler 210 as shown, for example, in FIGS. 7A and 7B. One preferred embodiment of a sidewall sprinkler generally includes a body 212, a deflector assembly 214, and a cover plate assembly 216. The sprinkler 210 is further preferably disposed within a mounting element 218 (not shown) for mounting to a wall structure. The mounting element 218 is preferably an escutcheon 218 as previously described having a proximal end face for engaging the wall structure. The mounting element 218 preferably tapers from the proximal end face to distal end face which is preferably located to a distal end of the body.

The sprinkler body 212 has a proximal portion 220 and a distal portion 222. The outer surface of the proximal portion 220 preferably includes a threaded end fitting for coupling the sprinkler 210 to a branch line of a sprinkler system containing a fire fighting fluid such as, for example, water or a pressurized gas such as compressed air. An inner surface portion of the body 212 further defines an internal passageway 224 extending between an inlet 226 and an outlet 228 along a longitudinal axis A2-A2. The inlet 226 is preferably in communication with tapering portion 224*a* of the passageway 224. The tapering passageway 224*a* is further preferably in communication with a portion 224*b* having a constant diameter and terminating at the outlet 228. The passageway 224, inlet 226 and outlet 228 further preferably define a sprinkler constant or K-factor ranging from about 3 gpm/(psi)$^{1/2}$ to about 5.8 gpm/(psi)$^{1/2}$ and is preferably about 5.6 gpm/(psi)$^{1/2}$.

The distal portion 222 preferably includes an annular wall 230 having an outer surface 234 and an inner surface 236 to further define a chamber 238 distal of the outlet 228 to house internal components of the sprinkler 210 including a deflector assembly 214 and a closure element 244. The proximal edge 232 of the annular wall can include additional openings to provide overflow space for a sidewall deflector 254.

Figure 9:
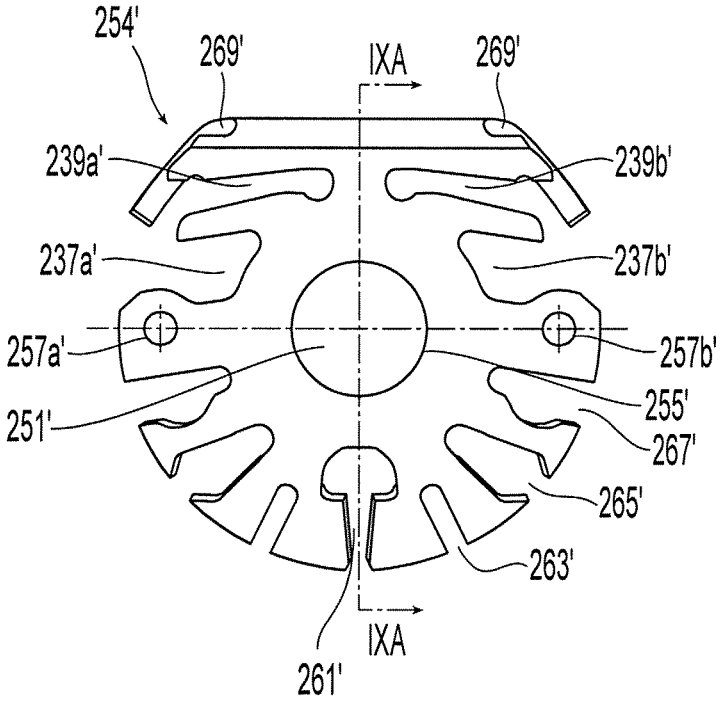
FIGS. 9 & 9A is another embodiment of a deflector for use with the sidewall sprinkler body of FIG. 7A.
Figure 10:
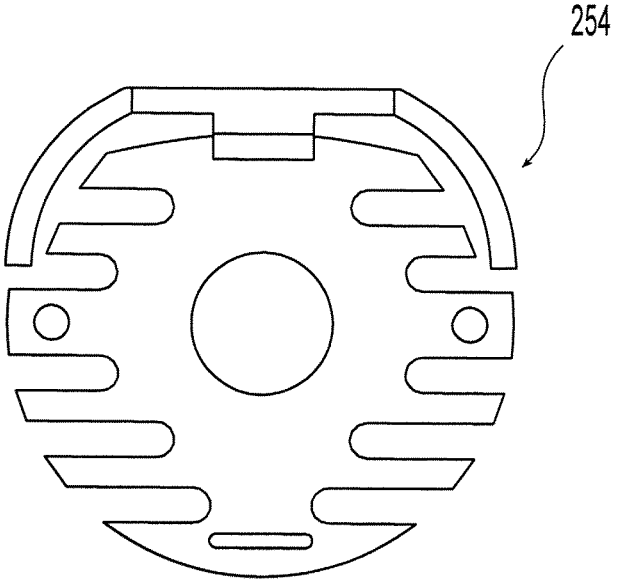
FIGS. 10 & 10A is another embodiment of a deflector for use with the sidewall sprinkler body of FIG. 7A.
Figure 10A:
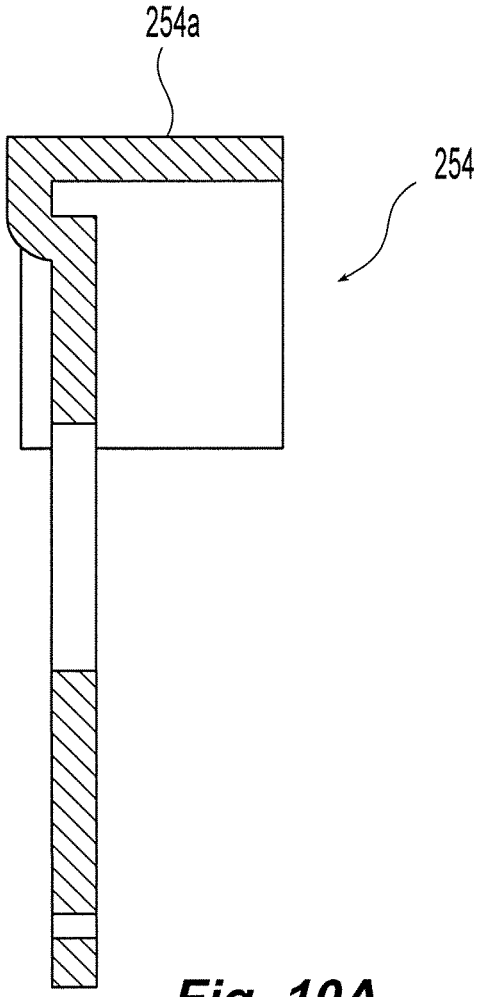

Coupled to the distal end 252 of each arm 248*a*, 248*b* of the deflector assembly 214 is the deflector plate 254 as seen, for example in FIGS. 9-10A. The deflector plate 254 is preferably configured as a sidewall deflector, and the deflector 254 preferably includes an axially extending portion 254*a* that can project through the opening 231 at the proximal edge 232 of the annular wall 230. The arms 248*a*, 248*b* preferably locates the deflector plate 254 at a first position within the chamber 238 distally adjacent the outlet 228. The deflector plate 254 further preferably includes a central hole, and engaged therein is the closure element 244. With the deflector plate 254 located at its first position, the closure element 244 is preferably located in the outlet of the passageway 228 to prevent the flow of a fluid (liquid or gas) from the outlet of the passageway 224*b*. The closure element 244 preferably includes a closure button 256 having a preferably frustroconical tip with a partial bore 258. Disposed about the frustroconical tip and engaged with a flange of the closure button 256 is a biasing element 260, preferably a Belleville spring disc having a spring force ranging from about 50 lbs. (222 Newtons) to about 120 lbs. (534 Newtons). With the closure element 244 in its sealing position, the frustroconical tip is preferably disposed within the passageway 224 and the biasing element 260 engages a preferably counter sunk surface forming the outlet 228 to the distal portion 224*b* of the passageway 224. The axial travel of the arms 248*a*, 248*b* locates the deflector plate 254 to at least a second position axially spaced from its first position and preferably axially spaced from the distal opening 242 to a location outside the chamber 238. With the deflector plate 254 in its second position, the closure element 244 is preferably spaced from the outlet 228 so as to permit any fluid (liquid or gas) supplied to the body 212 of the sprinkler 210 to discharge from the outlet 228. Liquid discharge from the outlet 228 can impact the axially displaced deflector plate 254 and therefore be distributed horizontally and vertically about an area beneath the sidewall sprinkler 210. To facilitate a distribution of fire fighting fluid in an area being protected by the sprinkler 210, the deflector plate 254 can include additional surfaces, a pattern of closed or open ended slits, slots, through holes, openings, cut-outs or any combination thereof to satisfy any one of a vertical or horizontal fluid distribution test.

Figure 7A:
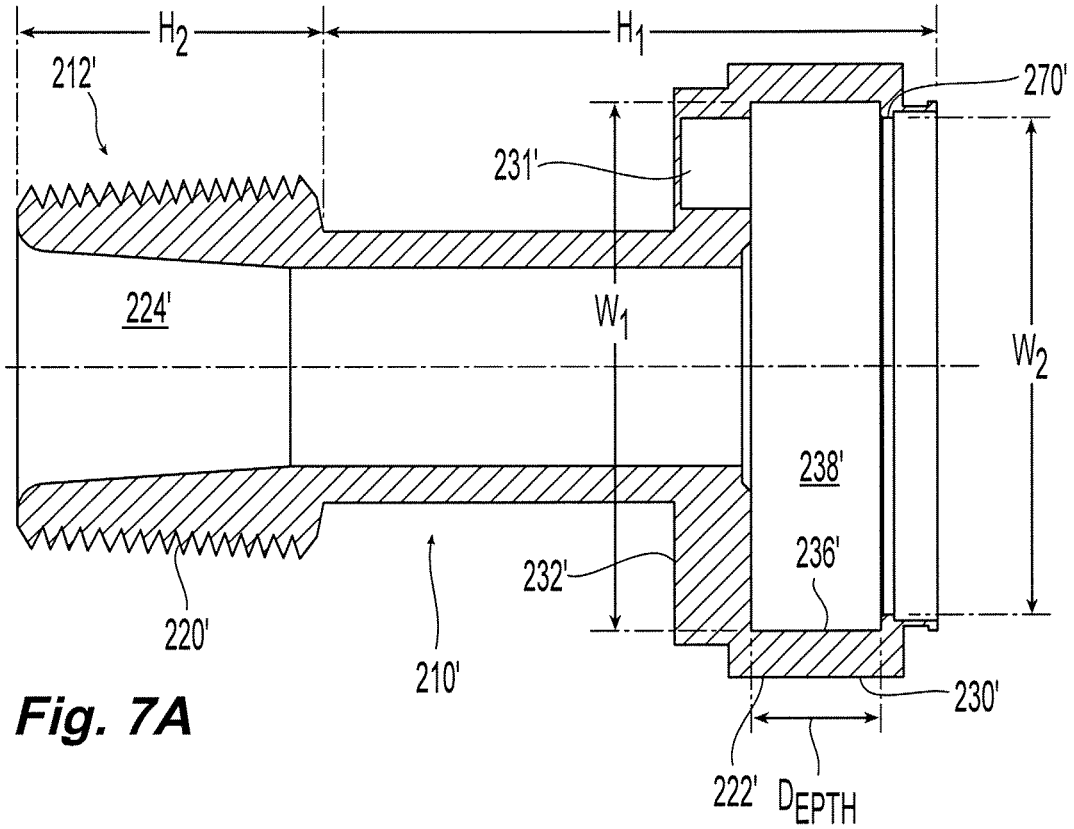
FIGS. 7A & 7B is a preferred sprinkler body for use in a preferred sidewall sprinkler.
Figure 7B:
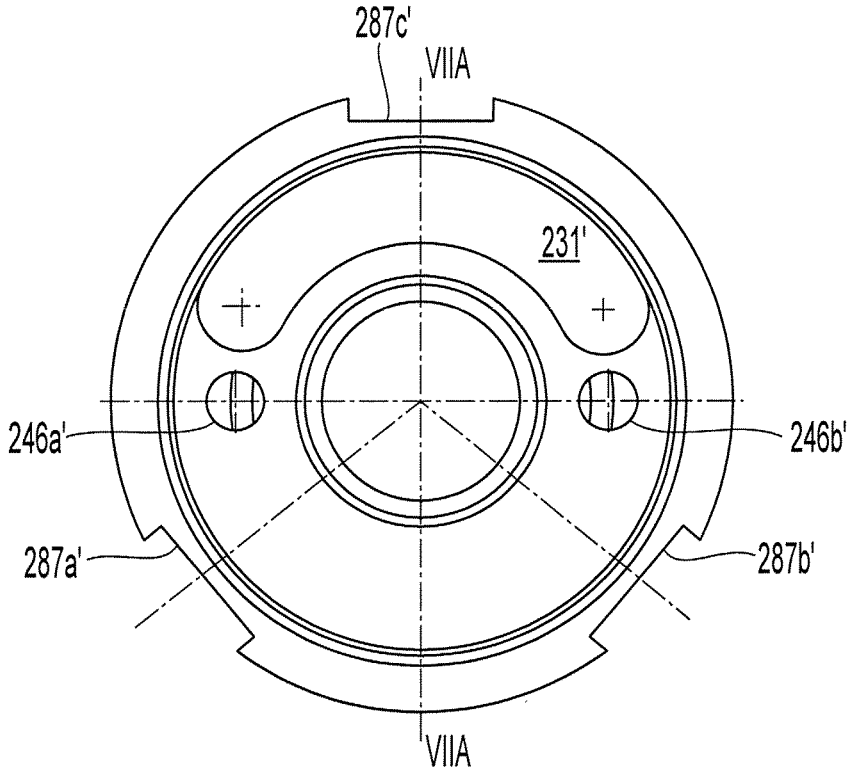

Shown in FIGS. 7A and 7B is a preferred sidewall sprinkler body 212' having a preferred overall height of about two inches. The distal portion 222' preferably includes an annular wall 230' having a proximal edge 232' contiguous and more preferably integral with the proximal portion 220'. The annular wall 230 includes an outer surface 234' and an inner surface 236' to further define a chamber 238' distal of the outlet 228'. The body 212' is preferably constructed such that the chamber 238' is in communication with the passageway 224'. Moreover, the chamber preferably defines a chamber height $D_{epth}$ of about 0.29 inches and more preferably ranging from about 0.288 inches to about 0.292 inches. The inner surface 236' further preferably defines a chamber diameter $W_1$ of about 1.7 inches and preferably ranging from about 1.168 inches to about 1.172 inches. The annular wall 230 further includes a distal edge 240 defining a distal opening 242 in communication with the chamber 238. The annular wall 230 preferably defines a first wall thickness, and the distal edge of the annular wall 240 defines a wall thickness that is preferably less than the first wall thickness.

The chamber 238' is configured for housing internal components of the sprinkler 210' including the deflector assembly 214' and a closure element 244'. The deflector assembly is coupled to the body 212' and is more preferably suspended in a telescoping manner from the proximal edge 232' by the of arms 248*a*, 248*b* engaged in the through holes 246*a*', 246*b*'. Shown in FIG. 7E is a preferred arm 248' having an enlarged proximal end 250' for engaging the proximal edge 232' of the annular wall 230' so as to limit the distal and axial travel of the arms in the through holes 246*a*', 246*b*' and a distal end 252' for controlling the distance of the deflector 254' relative to the outlet 228'. The preferred arm 248' has an overall axial length of about one inch and more preferably is about 1.044 inches. The width of the arm 248' preferably varies along its length. In particular, the arm 248' is widest at a proximal portion and narrowest at a distal portion. More specifically, the preferred arm 248' includes a distal portion 252' having a diameter of about 0.068 inches, an intermediate portion 253' having a diameter of about 0.118 inches and a proximal portion 255' having a diameter of about 0.127 inches. The wider proximal portion eliminates or otherwise minimizes the radial movement of the arms 248*a*, 248*b* within the through hole so as to stabilize the deflector at its most distal and actuated position. The proximal edge 232' preferably includes an additional opening 231' to provide a sprinkler assembler/installer access or view to the chamber 238'. Preferably, the proximal edge 232' includes one or more substantially semi-circular openings 231' disposed about the distal portion 222' of the body 212'. More preferably, the semi-circular openings 231' are configured to provide overflow space for a preferred sidewall deflector 254 as generally shown in FIGS. 10 and 10A.

Figure 9A:
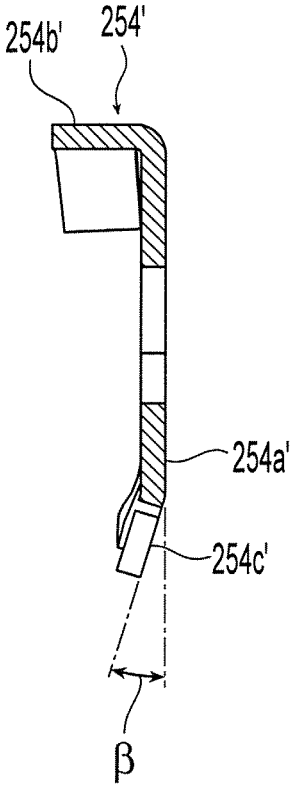

Shown in FIGS. 9 and 9A are respective plan and cross-sectional views of a preferred deflector 254' for use in the sidewall sprinkler 210'. The preferred deflector includes a face portion 254*a*', a hood portion 254*b*', and a bent peripheral portion 254*c*'. When the deflector 254' is installed in the preferred sprinkler 210', the face portion 254*a*' is disposed substantially orthogonally to the sprinkler axis A2-A2, the bent peripheral portion 254*c*' extends at an angle β, preferably about seventeen degrees (17°) proximally from the face portion 254*a*'. The hood portion 254*b*' extends substantially orthogonally from the face portion 254*a*' and when in the unactuated condition, the hood extends proximally through the opening 231' on the proximal edge 232'.

The face portion 254*a*' includes a central hole 251' for engagement with the button 244 and two through holes disposed about the central hole 257*a*', 257*b*' for engagement with the distal ends 252' of the arms 248'. Referring again to FIGS. 9 and 9A, the preferred deflector includes a plurality of slots of varying geometry symmetrically disposed about the face portion 254*a*' and the bent peripheral portion 254*b*'. More specifically, the face portion 254*a*' includes two pairs of open-ended slots 237*a*', 237*b*', 239*a*', 239*b*'. In which the slots 237*a*', 237*b*', 239*a*', 239*b*' vary in length and in width. Preferably, one slot pair 237*a*', 237*b*' narrows as it approaches the peripheral edge of the face portion and the other pair 239*a*' 239*b*' widens as it approaches the peripheral edge. The peripheral bent portion also includes a plurality of open-ended slots symmetrically disposed about the deflector axis IXA-IXA. One preferred slot 261' includes a slot that narrows at it approaches the peripheral edge of the portion 254*b*' and is substantially axially aligned with the deflector axis IXA-IXA. Disposed about the slot 261', are at least three other slot pairs 263', 265' and 267'. The slot pairs provide combinations of varying slot lengths and widths in which at least one pair 263' maintains a substantially constant width along its slot length, at least one pair 265' widens and then narrows as it approaches the peripheral edge, and a third pair 267' that broadens as it approaches the peripheral edge. The hood portion 254*b*', preferably includes at least one pair of slots 269' uniformly disposed about the deflector axis IXA-IXA. Any one of the plurality of slots can further include one or more radiused portions in combination with the one or more of the features described above, provided the sprinkler provides the desired fluid distribution performance, for example, in accordance with one or more horizontal or vertical water distribution tests under the standards.

Figure 8A:
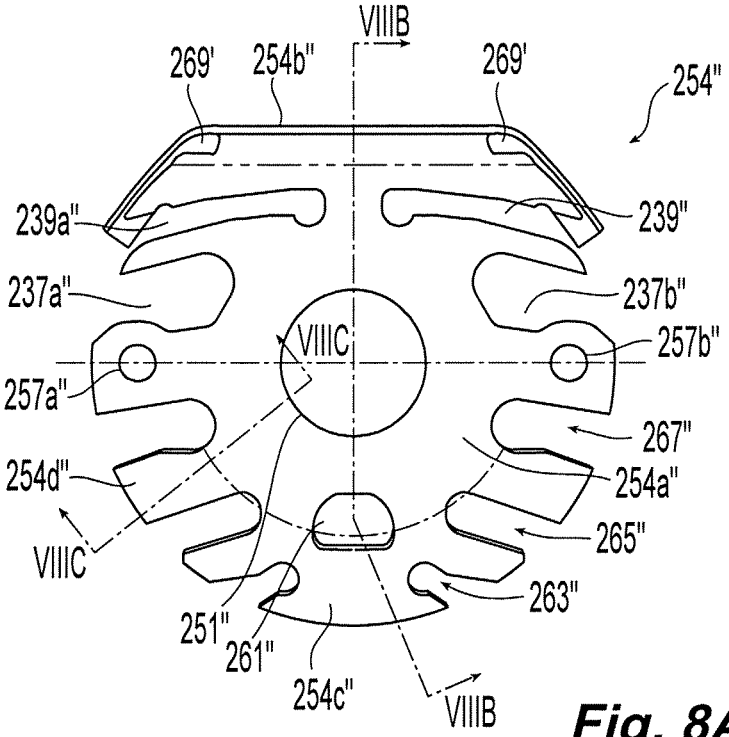
FIGS. 8A, 8B & 8C is one embodiment of a deflector for use with the sidewall sprinkler body of FIG. 7A.
Figure 8B:
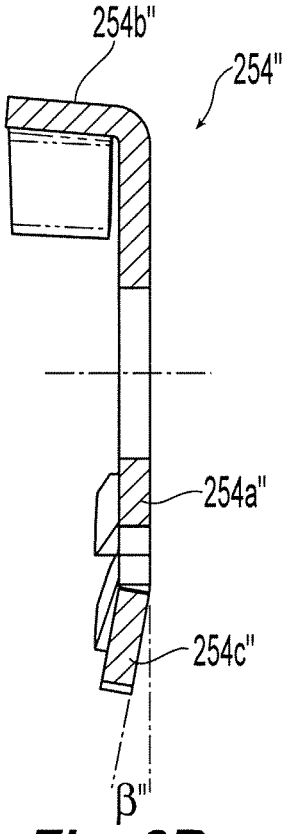
Figure 8C:
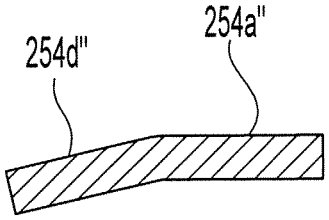

Shown in FIGS. 8A, 8B, and 8C are respective plan and cross-sectional views of a preferred deflector 254" for use in the sidewall sprinkler 210 of FIG. 7A and configured for extended coverage. The preferred deflector includes a face portion 254*a*", a hood portion 254*b*", a first bent peripheral portion 254*c*", and a second bent peripheral portion 254*d*". When the deflector 254" is installed in the preferred sprinkler 210, the face portion 254*a*" is disposed substantially orthogonally to the sprinkler axis A2-A2, the first bent peripheral portion 254*c*" extends at an angle β1", preferably about seventeen degrees (17°) proximally from the face portion 254*a*", and the first bent peripheral portion 254*c*" extends at an angle β2", preferably about seventeen degrees (13°) proximally from the face portion 254*a*". The hood portion 254*b*" extends substantially orthogonally from the face portion 254*a*" and when in the unactuated condition, the hood extends proximally through the opening 231' on the proximal edge 232'.

The face portion 254*a*" includes a central hole 251" for engagement with the button 244 and two through holes disposed about the central hole 257*a*", 257*b*" for engagement with the distal ends 252' of the arms 248'. The preferred deflector 254" includes a plurality of slots of varying geometry symmetrically disposed about the face portion 254*a*" and the first bent peripheral portion 254*b*". More specifically, the face portion 254*a*" includes two pairs of open-ended slots 237*a*", 237*b*", 239*a*", 239*b*", in which the slots 237*a*", 237*b*", 239*a*", 239*b*" vary in length and in width. Preferably, one slot pair 237*a*", 237*b*" narrows as it approaches the peripheral edge of the face portion and the other pair 239*a*", 239*b*" widens as it approaches the peripheral edge. The peripheral bent portion also includes a plurality of open-ended slots symmetrically disposed about the deflector axis VIIIA-VIIIA. A preferred through hole 261" is substantially axially aligned with the deflector axis VIIIA-VIIIA. Disposed about the through hole 261', are at least three other slot pairs 263", 265" and 267". The slot pairs provide combinations of varying slot lengths and widths in which at least one pair 263" has an initial slot width and terminates in substantially circular terminal end having a diameter wider than the initial slot width. At least one pair of slots 265" slightly narrows as it approaches the peripheral edge, and a third pair 267' that broadens as it approaches the peripheral edge. The hood portion **254*b'''*, preferably includes at least one pair of slots 269'** uniformly disposed about the deflector axis XVIIA-XVIIA. Any one of the plurality of slots can further include one or more radiused portions in combination with the one or more of the features described above, provided the sprinkler provides the desired fluid distribution performance, for example, in accordance with one or more horizontal or vertical water distribution tests under the standards.

While the present invention has been disclosed with reference to certain embodiments, numerous modifications, alterations, and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What is claimed is:

1. A sprinkler and escutcheon assembly comprising:

a body having a proximal portion defining an opening and a distal portion defining an outlet, the body defining an internal passageway having an inlet and an outlet spaced apart along a longitudinal axis, the distal portion including an annular wall having an outer surface and an inner surface to further define a chamber distal of the outlet to house an internal component of the sprinkler;

a cover plate assembly having a thermally responsive surface exposed to the chamber to actuate the sprinkler;

a spacing member disposed between the annular wall and the cover plate assembly, the spacing member defining at least one aperture to provide communication between the chamber and an environment external to the sprinkler body such that the surface of the cover plate assembly is exposed to the external environment; and an escutcheon disposed about the annular wall, the escutcheon including a proximal end face and a distal end face, the escutcheon tapering in the proximal to distal direction toward the axis such that the distal end face of the escutcheon is located proximally of the spacing member and redirects air flow into the at least one aperture.

2. The sprinkler and escutcheon assembly of claim 1, wherein the spacing member comprises a ring member having a plurality of radially spaced apart posts to define the at least one aperture.

3. The sprinkler and escutcheon assembly of claim 1, wherein the cover plate assembly comprises at least two overlapping plate members.

4. The sprinkler and escutcheon assembly of claim 2, wherein the at least two overlapping plate members define a substantially circular assembly.

5. The sprinkler and escutcheon assembly of claim 1, wherein the internal component comprises a deflector assembly including at least one pair of arms and a deflector plate engaged with the at least one pair of arms, the deflector plate including a plurality of open ended slots, the plurality of slots having a first group of slots and at least a second group of slots, the first group of slots having slot widths and slot lengths that vary from the second group of slot widths and lengths.

6. The sprinkler and escutcheon assembly of claim 5, wherein the deflector plate is configured for any one of standard coverage, extended coverage, or residential coverage.

7. The sprinkler and escutcheon assembly of claim 5, wherein the at least one pair of arms comprises two pair of arms.

8. The sprinkler and escutcheon assembly of claim 1, wherein the internal components comprise a closure assembly and a trigger assembly, the trigger assembly including a lever assembly engaged with the sprinkler body and the cover plate assembly to support the closure assembly in a sealed position.

9. The sprinkler and escutcheon assembly of claim 8, wherein the lever assembly includes a pair of lever members with a plug disposed between the lever members.

10. The sprinkler and escutcheon assembly of claim 8, wherein the lever assembly consists of a single lever member.

11. The sprinkler and escutcheon assembly of claim 1, where the sprinkler is configured for installation as a sidewall sprinkler.

12. The sprinkler and escutcheon assembly of claim 11, wherein the internal component includes a deflector assembly, the deflector assembly having a deflector that includes a hood portion.

13. The sprinkler and escutcheon assembly of claim 12, wherein the deflector plate is configured for any one of standard coverage, extended coverage, or residential coverage.

14. The sprinkler and escutcheon assembly of claim 12, wherein the deflector plate includes a plurality of open ended slots, the plurality of slots having a first group of slots and at least a second group of slots, the first group of slots having slot widths and slot lengths that vary from the second group of slot widths and lengths.

15. A sprinkler and escutcheon assembly comprising:

a body having a proximal portion defining an opening and a distal portion defining an outlet, the body defining an internal passageway having an inlet and an outlet spaced apart along a longitudinal axis, the distal portion including an annular wall having an outer surface and an inner surface to further define a chamber distal of the outlet to house an internal component of the sprinkler;

a cover plate assembly having a thermally responsive surface exposed to the chamber to actuate the sprinkler;

means for providing a plurality of apertures radially disposed about the longitudinal axis between the annular wall and the cover plate assembly, the apertures being configured to provide communication between the chamber and an environment external to the body such that the surface of the cover plate assembly is exposed to the external environment; and an escutcheon disposed about the annular wall, the escutcheon including a proximal end face and a distal end face, the escutcheon tapering in the proximal to distal direction toward the axis such that the distal end face of the escutcheon is located proximally of the plurality of apertures and redirects air flow into the plurality of apertures.

16. The sprinkler and escutcheon assembly of claim 1, wherein the proximal end face and the distal end face of the escutcheon are spaced apart to define an escutcheon height of 0.4 inches.

17. The sprinkler and escutcheon assembly of claim 1, wherein the annular wall has a proximal edge and a distal edge, the distal end face of the escutcheon defines an opening and the proximal end face of the escutcheon defines an internal backstop, the body being inserted in the opening such that the internal backstop engages the proximal edge of the annular wall to locate the distal end face of the escutcheon flush with the distal edge of the annular wall proximal the spacing member.

18. The sprinkler and escutcheon assembly of claim 1, wherein the distal end face of the escutcheon defines an opening with the body inserted in the opening such that the body and escutcheon are installed together for coupling to a fluid supply line.

19. The sprinkler and escutcheon assembly of claim 1, wherein the proximal end face and the distal end face of the escutcheon are spaced apart to define an escutcheon height such that upon installation, the escutcheon height locates the distal end face of the escutcheon proximal the at least one aperture.

20. The sprinkler and escutcheon assembly of claim 1, wherein the escutcheon is a push-on escutcheon for installation about the annular wall after the body is installed and coupled to a fluid supply line.

21. The sprinkler and escutcheon assembly of claim 20, wherein the escutcheon includes a central opening formed by a plurality of radially disposed tabs that engage the annular wall.

22. The sprinkler and escutcheon assembly of claim 21, wherein the annular wall includes a circumferentially formed groove, the plurality of tabs being resilient members having a central portion that is biased inward to engage the centrally formed groove.

23. The sprinkler and escutcheon assembly of claim 21, wherein the plurality of tabs present a convex profile to form an interference fit about the annular wall.

24. The sprinkler and escutcheon assembly of claim 20, wherein the proximal end face and the distal end face of the escutcheon are spaced apart to define an escutcheon height that locates the distal end face of the escutcheon proximal the at least one aperture of the spacing member.

25. The sprinkler and escutcheon assembly of claim 15, wherein the internal component include a closure assembly to seal the outlet of the passageway, a deflector assembly engaged with the closure assembly, and a trigger assembly engaged with the body and the cover plate assembly to support the closure assembly in the seal position.

26. The sprinkler and escutcheon assembly of claim 15, wherein the means comprises the distal portion of the sprinkler body defining the plurality of apertures.

27. The sprinkler and escutcheon assembly of claim 15, wherein the means comprises a lip portion of the cover plate assembly, the lip portion defining the plurality of apertures.

28. The sprinkler and escutcheon assembly of claim 15, wherein the means comprises a ring member having a plurality of radially spaced posts engaged with the cover plate assembly so as to define the plurality of apertures.

29. The sprinkler and escutcheon assembly of claim 15, wherein the proximal end face and the distal end face of the escutcheon are spaced apart to define an escutcheon height of 0.4 inches.

30. The sprinkler and escutcheon assembly of claim 15, wherein the annular wall has a proximal edge and a distal edge, the distal end face of the escutcheon defines an opening and the proximal end face of the escutcheon defines an internal backstop, the body being inserted in the opening such that the internal backstop engages the proximal edge of the annular wall to locate the distal end face of the escutcheon flush with the distal edge of the annular wall proximal the spacing member.

31. The sprinkler and escutcheon assembly of claim 15, wherein the distal end face of the escutcheon defines an opening with the body inserted in the opening such that the body and escutcheon are installed together for coupling to a fluid supply line.

32. The sprinkler and escutcheon assembly of claim 15, wherein the proximal end face and the distal end face of the escutcheon are spaced apart to define an escutcheon height such that upon installation, the escutcheon height locates the distal end face of the escutcheon proximal the plurality of apertures.

33. The sprinkler and escutcheon assembly of claim 15, wherein the escutcheon is a push-on escutcheon for installation about the annular wall after the body is installed and coupled to a fluid supply line.

34. The sprinkler and escutcheon assembly of claim 33, wherein the escutcheon defines a central opening formed by a plurality of radially disposed tabs that engage the annular wall.

35. The sprinkler and escutcheon assembly of claim 33, wherein the annular wall includes a circumferentially formed groove, the plurality of tabs being resilient members having a central portion that is biased inward to engage the centrally formed groove and locate the distal end face of the escutcheon proximal the plurality of apertures.

36. The sprinkler and escutcheon assembly of claim 33, wherein the plurality of tabs present a convex profile to form an interference fit about the annular wall.

37. The sprinkler and escutcheon assembly of claim 33, wherein the proximal end face and the distal end face of the escutcheon are spaced apart to define an escutcheon height that locates the distal end face of the escutcheon proximal the plurality of apertures.

* * * * *